US009996018B2

(12) United States Patent
Kubo et al.

(10) Patent No.: US 9,996,018 B2
(45) **Date of Patent: *Jun. 12, 2018**

(54) TONER AND METHOD FOR MANUFACTURING THE SAME

(71) Applicant: CANON KABUSHIKI KAISHA, Tokyo (JP)

(72) Inventors: Haruko Kubo, Susono (JP); Yu Yoshida, Mishima (JP); Yuhei Terui, Numazu (JP); Hitoshi Itabashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/251,748

(22) Filed: Aug. 30, 2016

(65) Prior Publication Data

US 2017/0060015 A1 Mar. 2, 2017

(30) Foreign Application Priority Data

Sep. 1, 2015 (JP) ..... 2015-171912

(51) Int. Cl.
*G03G 9/09* (2006.01)
*G03G 9/08* (2006.01)
*G03G 9/087* (2006.01)

(52) U.S. Cl.
CPC ..... *G03G 9/0926* (2013.01); *G03G 9/0804* (2013.01); *G03G 9/08702* (2013.01); *G03G 9/08755* (2013.01); *G03G 9/08795* (2013.01)

(58) Field of Classification Search
CPC ..... G03G 9/0926; G03G 9/08795; G03G 9/0804; G03G 9/08702; G03G 9/08755; G03G 9/0902; G03G 9/0906
See application file for complete search history.

(56) References Cited

U.S. PATENT DOCUMENTS 9,505,723 B2 * 11/2016 Kubo ..... C07C 233/18
2010/0035171 A1 * 2/2010 Watanabe ..... C09B 29/363 430/108.23

FOREIGN PATENT DOCUMENTS

| | | | |
|---|---|---|---|
| JP | H10316643 | A | 12/1998 |
| JP | 2003238837 | A | 8/2003 |
| JP | 2013209642 | A | 10/2013 |
| JP | 2014098840 | A | 5/2014 |
| JP | 2014209191 | A | 11/2014 |
| JP | 2015063683 | A | 4/2015 |

* cited by examiner

*Primary Examiner* — Thorl Chea
(74) *Attorney, Agent, or Firm* — Canon U.S.A. Inc., IP Division

(57) ABSTRACT

In a toner containing a resin, a pigment, and a pigment dispersant, the resin contains a polar resin having an acid value of 2.0 to 30.0 mgKOH/g, and the pigment dispersant has the structure represented by the following formula (1) and a polymer moiety bonded thereto.

(1)

10 Claims, 1 Drawing Sheet

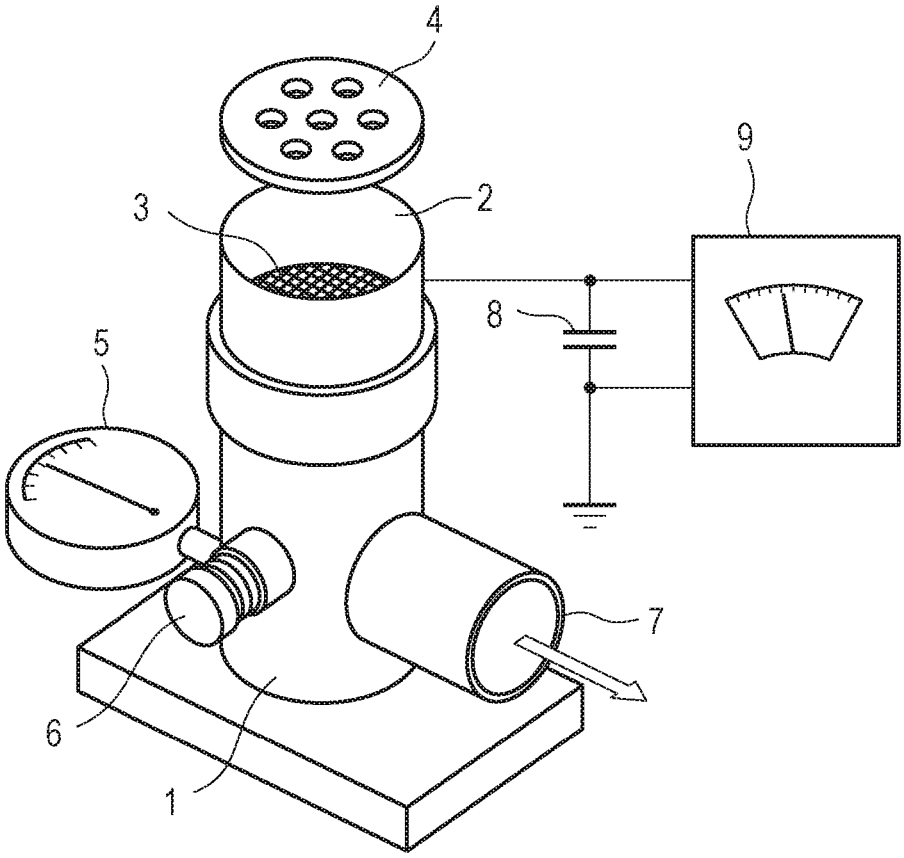
4
9
3
2
8
5
7
6
1

TONER AND METHOD FOR MANUFACTURING THE SAME

BACKGROUND OF THE INVENTION

Field of the Invention

Aspects of the present invention relate to a toner used for an image forming method, such as an electrophotographic method, an electrostatic recording method, or a toner jetting method, and a method for manufacturing a toner.

Description of the Related Art

In recent years, in the fields of printers, copying machines, and the like, the image quality is required to be stable for a long period of time regardless of use environments. In order to satisfy this requirement, a toner excellent in coloring power, charging property, and durability has been desired.

In order to improve the coloring power of a toner, it is effective to finely disperse a pigment. As a method to improve the dispersibility of a pigment, the use of a pigment dispersant has been performed, and many types of pigment dispersants have been proposed. Japanese Patent Laid-Open No. 2003-238837 has disclosed a pigment dispersant using a compound which contains a partial skeleton of an organic dye.

In addition, as the use environment is diversified, the charging property and the durability of toners have been improved, and Japanese Patent Laid-Open No. 2014-209191 has disclosed a novel charge control agent for improvement in charging property.

SUMMARY OF THE INVENTION

However, by the pigment dispersant disclosed in Japanese Patent Laid-Open No. 2003-238837, although the pigment dispersibility is improved, there has been still some room for improvement. In addition, when the material disclosed in Japanese Patent Laid-Open No. 2014-209191 is used, although the charging property is improved, a sufficient effect has not been obtained.

Aspects of the present invention provide a toner which is able to further improve the coloring power and which is excellent in charging property and durability and a method for manufacturing the toner described above.

Aspects of the present invention relate to a toner comprising a toner particle, the toner particle containing a resin, a pigment, and a pigment dispersant, wherein:

the resin comprises a polar resin having an acid value of 2.0 to 30.0 mgKOH/g, and the pigment dispersant has the structure represented by the following formula (1) or a tautomer thereof, and a polymer moiety.

(1)

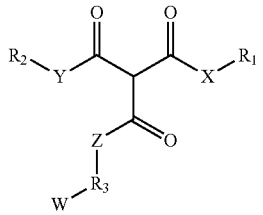

In the above formula (1), X, Y and Z each independently represent —O—, a methylene group, or —$NR^4$—. $R^4$ represents a hydrogen atom, or a linear or branched alkyl group having 1 to 4 carbon atoms.

$R_1$ represents a substituted or unsubstituted phenyl group, a polycyclic aromatic group, or a heterocyclic group.

$R_2$ represents a hydrogen atom, a substituted or unsubstituted phenyl group, an aralkyl group, a linear, branched, or cyclic alkyl group having 1 to 18 carbon atoms, or a monovalent group obtained by substituting a methylene group of a main chain of an alkyl group having 1 to 18 carbon atoms by an ether bond, an ester bond, or an amide bond.

$R_3$ represents a substituted or unsubstituted phenylene group, a linear, branched, or cyclic alkylene group having 1 to 18 carbon atoms, or a divalent group obtained by substituting a methylene group of a main chain of an alkylene group having 1 to 18 carbon atoms by an ether bond, an ester bond, or an amide bond.

W represents a linking group to the polymer moiety.

A substituent of the substituted phenyl group and a substituent of the substituted phenylene group are each a methyl group, a methoxy group, a hydroxy group, a nitro group, a chloro group, a carboxy group, an amino group, a dimethylamino group, a carboxylic acid amide group, or a ureido group.

The polycyclic aromatic group is a group derived from naphthalene, anthracene, phenanthrene, or anthraquinone by removing one hydrogen atom therefrom.

The heterocyclic group is a group derived from imidazole, oxazole, thiazole, pyridine, indole, benzimidazole, benzimidazolinone, or phthalimide by removing one hydrogen atom therefrom.

In addition, aspects of the present invention relate to a method for manufacturing the toner described above, and the method comprises forming a particle in an aqueous medium to obtain the toner particle described above.

Further aspects of the present invention will become apparent from the following description of exemplary embodiments with reference to the attached drawing.

BRIEF DESCRIPTION OF THE DRAWING

FIG. 1 is a schematic view of an apparatus used for measurement of an electric charge amount according to aspects of the present invention.

DESCRIPTION OF THE EMBODIMENTS

Aspects of the present invention are characterized in that a resin in a toner contains a polar resin having an acid value of 2.0 to 30.0 mgKOH/g, and a pigment dispersant in the toner has the structure represented by formula (1) and a polymer (high molecular weight chain).

The reasons the coloring power of the toner is further improved by the characteristics described above, and the charging property and the durability thereof are also excellent thereby are construed by the present inventors as described below. The structure represented by the formula (1) functioning as a pigment adsorbing portion of the pigment dispersant is characterized by having a plurality of polar groups because of a triketone structure and a high structural flexibility. Hence, it is believed that the pigment adsorbing portion is able to adsorb to the pigment at a plurality of points and is also able to arbitrarily change an adsorbing direction in accordance with the functional group of a pigment. In addition, the pigment adsorbing portion is able to cause intramolecular keto-enol tautomerism and is able to expand a it plane of the compound thereby. Hence, it is believed that after adsorbing to the pigment surface, the pigment dispersant causes the structural isomerism due to the interaction with the functional group on the pigment surface, and the flatness of the adsorbing portion is improved, so that the pigment dispersant is able to tightly adsorb to the pigment.

When the pigment is unevenly distributed on the surfaces of toner particles, a sufficient charging property, such as a rapid charge buildup rate or a stable charge amount, are not likely to be obtained due the charge-up of the pigment. In aspects of the present invention, it is believed that by the characteristics of the pigment dispersant having the structure represented by the formula (1), the functional groups on the pigment surface may be reliably covered with the pigment dispersant. Hence, it is believed that since the charge-up of the pigment in the toner particle is suppressed, the charging property is improved.

In addition, since the pigment adsorbing portion of the pigment dispersant used in aspects of the present invention has a high adsorption performance to the pigment, the interaction of the pigment with the polar resin can be suppressed. Hence, it is believed that when this pigment dispersant is used, since the surface layer formation of the toner particle by the polar resin is not inhibited, the durability is also improved.

According to those described above, it is believed that in aspects of the present invention, since the pigment adsorbing portion has a high adsorption performance to the pigment due to the structure represented by the formula (I), the coloring power of the toner is further improved, and the advantages, such as excellent charging property and durability, are obtained.

The pigment dispersant used in aspects of the present invention is formed so that the structure represented by the following formula (1) is bonded to a polymer moiety. The structure represented by the following formula (1) functions as a pigment adsorbing portion having a high affinity to the pigment. The polymer moiety is a portion which has a high affinity to a dispersion medium and which functions as a dispersing portion suppressing aggregation between pigment particles.

(1)

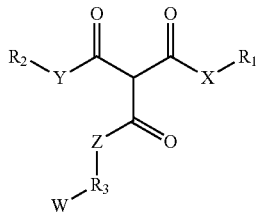

In the formula (1), X, Y and Z each independently represent —O—, a methylene group, or —$NR^4$—. $R^4$ represents a hydrogen atom, or a linear or branched alkyl group having 1 to 4 carbon atoms. $R_1$ represents a substituted or unsubstituted phenyl group, a polycyclic aromatic group, or a heterocyclic group. $R_2$ represents a hydrogen atom, a substituted or unsubstituted phenyl group, an aralkyl group, a linear, branched, or cyclic alkyl group having 1 to 18 carbon atoms, or a monovalent group obtained by substituting a methylene group of a main chain of an alkyl group having 1 to 18 carbon atoms by an ether bond, an ester bond, or an amide bond.

$R_3$ represents a substituted or unsubstituted phenylene group, a linear, branched, or cyclic alkylene group having 1 to 18 carbon atoms, or a divalent group obtained by substituting a methylene group of a main chain of an alkylene group having 1 to 18 carbon atoms by an ether bond, an ester bond, or an amide bond.

W represents a linking group to the polymer moiety.

A substituent of the substituted phenyl group and a substituent of the substituted phenylene group are each a methyl group, a methoxy group, a hydroxy group, a nitro group, a chloro group, a carboxy group, an amino group, a dimethylamino group, a carboxylic acid amide group, or a ureido group.

The polycyclic aromatic group is a group derived from naphthalene, anthracene, phenanthrene, or anthraquinone by removing one hydrogen atom therefrom.

The heterocyclic group is a group derived from imidazole, oxazole, thiazole, pyridine, indole, benzimidazole, benzimidazolinone, or phthalimide by removing one hydrogen atom therefrom.

$R_1$ in the formula (1) is a portion primarily responsible for a π-π interaction with the pigment. Hence, $R_1$ preferably represents a compound having a π flatness. In particular, a heterocyclic compound and an aromatic compound substituted by a polar group are preferable since having both a π flatness and a hydrogen bonding property. Among the polycyclic aromatic groups, $R_1$ more preferably represents a benzimidazolinone structure. Since having both a high structural flatness and a strong hydrogen bonding property, the benzimidazolinone structure has a high adsorbing property to the pigment, and the coloring power is further improved.

Although the groups mentioned above may be used as X, Y, and Z, when at least two of X, Y, and Z each represent —NH—, it is preferable since the structural stability of the compound is improved. In particular, X and Z each preferably represent —NH—. The reason for this is that when X represents —NH—, an amide bond is formed, and adsorption to the pigment is more likely to be improved. In addition, from a manufacturing point of view, Z preferably represents —NH—. In addition, in order to enable $R_2$ to have various structures, Y preferably represents —O—.

W is a linking group to the polymer moiety and preferably represents an amide bond or an ester bond in view of easy manufacturing.

The structure represented by the formula (1) is able to have the following tautomer structures. Those tautomers are also in the range of the pigment dispersant used in aspects of the present invention.

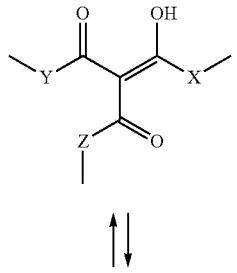

-continued

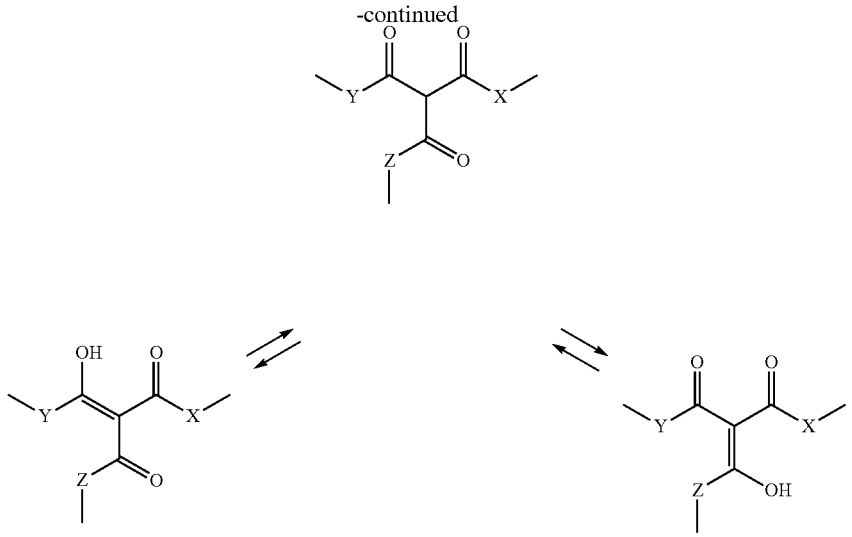

The adsorption action of the pigment adsorbing portion of aspects of the present invention includes a hydrogen bonding action by a polar group, such as a ketone, an amide, or an ester, and a π-π interaction derived from an aromatic structure. The pigment adsorbing portion of this pigment dispersant is characterized in that the triketone structure represented by the formula (1) is contained in its molecule. In order to enable the triketone structure to be stably present from a chemical point of view, the three ketones are required to be directed in different directions and to have three adsorbing points. In addition, since the conjugate property of the molecule is low in a triketone state, it is estimated that the pigment adsorbing portion has a high flexibility and a high degree of structural freedom. In addition, the pigment adsorbing portion of aspects of the present invention is able to have an intramolecular keto-enol tautomer structure. In this case, the π flatness of the pigment adsorbing portion is significantly improved. Hence, since the direction of the bonding can be arbitrarily adjusted in accordance with a pigment to which the pigment adsorbing portion adsorbs, and since stable adsorption is obtained by the structural isomerism which occurs after the adsorption, it is believed that the adsorption performance to the pigment is improved.

The structure represented by the formula (1) is preferably the structure represented by the following formula (2).

(2)

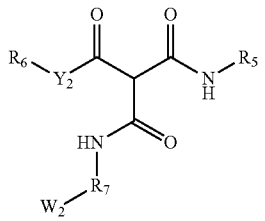

In the formula (2), $Y_2$ represents —O—, a methylene group, or —NH—.

$R_6$ represents a hydrogen atom, a substituted or unsubstituted phenyl group, an aralkyl group, or a linear or branched alkyl group having 1 to 18 carbon atoms.

$R_5$ represents a substituted or unsubstituted phenyl group, a polycyclic aromatic group, or a heterocyclic group. $R_7$ represents a linear or branched ylene group having 1 to 8 carbon atoms, a divalent group obtained by substituting a methylene group of a main chain of an alkylene group having 1 to 8 carbon atoms by an ether bond, an ester bond, or an amide bond, or a substituted or an unsubstituted phenylene group.

$W_2$ represents a linking group to the polymer moiety, and the linking group is an ester bond or an amide bond.

The substituent of the substituted phenyl group and the substituent of the substituted phenylene group are each a methyl group, a methoxy group, a hydroxy group, nitro group, chloro group, a carboxy group, an amino group, a dimethylamino group, a carboxylic acid amide group, or a ureido group.

The polycyclic aromatic group is a group derived from naphthalene, anthracene, phenanthrene, or anthraquinone by removing one hydrogen atom therefrom.

The heterocyclic group is a group derived from imidazole, oxazole, thiazole, pyridine, indole, benzimidazole, benzimidazolinone, or phthalimide by removing one hydrogen atom therefrom.

When the pigment dispersant has the structure represented by the formula (2), since the stability of the compound is improved, the adsorbing property to the pigment is further improved. As a result, a preferable coloring power and a preferable charging property are likely to be obtained.

The structure represented by the formula (2) is able to have the following tautomer structures.

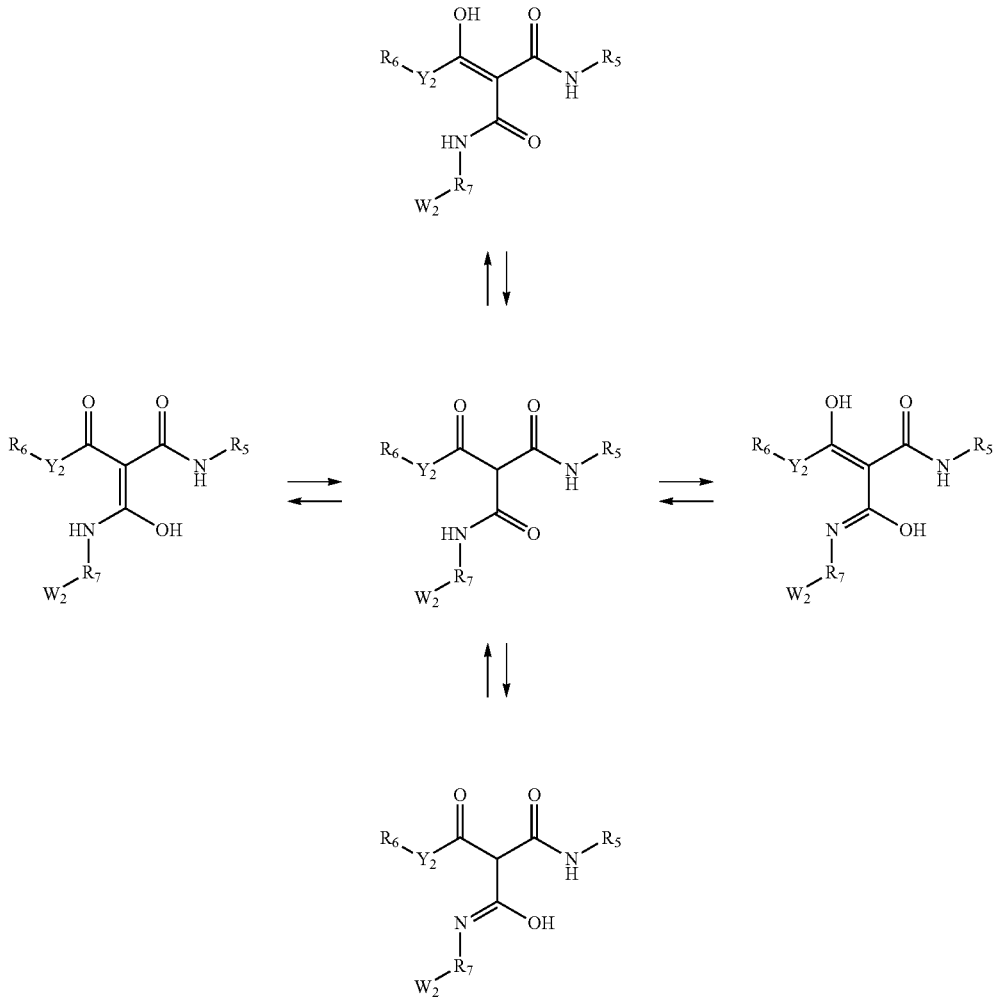

As the structure represented by the formula (2), the structure represented by the following formula (3) is more preferable.

(3)

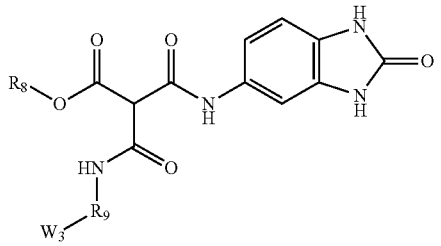

In the formula (3), $R_3$ represents an alkyl group having 1 to 12 carbon atoms or a benzyl group.

$R_9$ represents an alkylene group having 2 to 4 carbon atoms.

$W_3$ represents a linking group to the polymer moiety, and the linking group is an ester bond or an amide bond.

When $R_9$ represents an alkylene group having 2 to carbon atoms, since the pigment adsorbing portion has a preferable solubility, the aggregation of the pigment adsorbing portion is suppressed, and the coloring power is likely to be improved.

When $R_8$ represent an alkyl group having 1 to 12 carbon atoms or a benzyl group, since the group mentioned above is not bulky, the adsorption to the pigment is not likely to be inhibited. Accordingly, since the adsorbing rate to the pigment is maintained, a preferable coloring power is likely to be obtained.

The structure represented by the formula (3) has a benzimidazolinone structure (the portion corresponding to in the formula (2)). As described above, by the benzimidazolinone structure, a high adsorbing property to the pigment is obtained, and the coloring power is further improved.

As described above, by the structure represented by the formula (3), since the hydrogen bonding action to the pigment and the π-π interaction are enhanced, the adsorption to the pigment is more likely to occur. As a result, more excellent coloring power and charging property may be obtained.

The structure represented by the formula (3) is able to have the following tautomer structures.

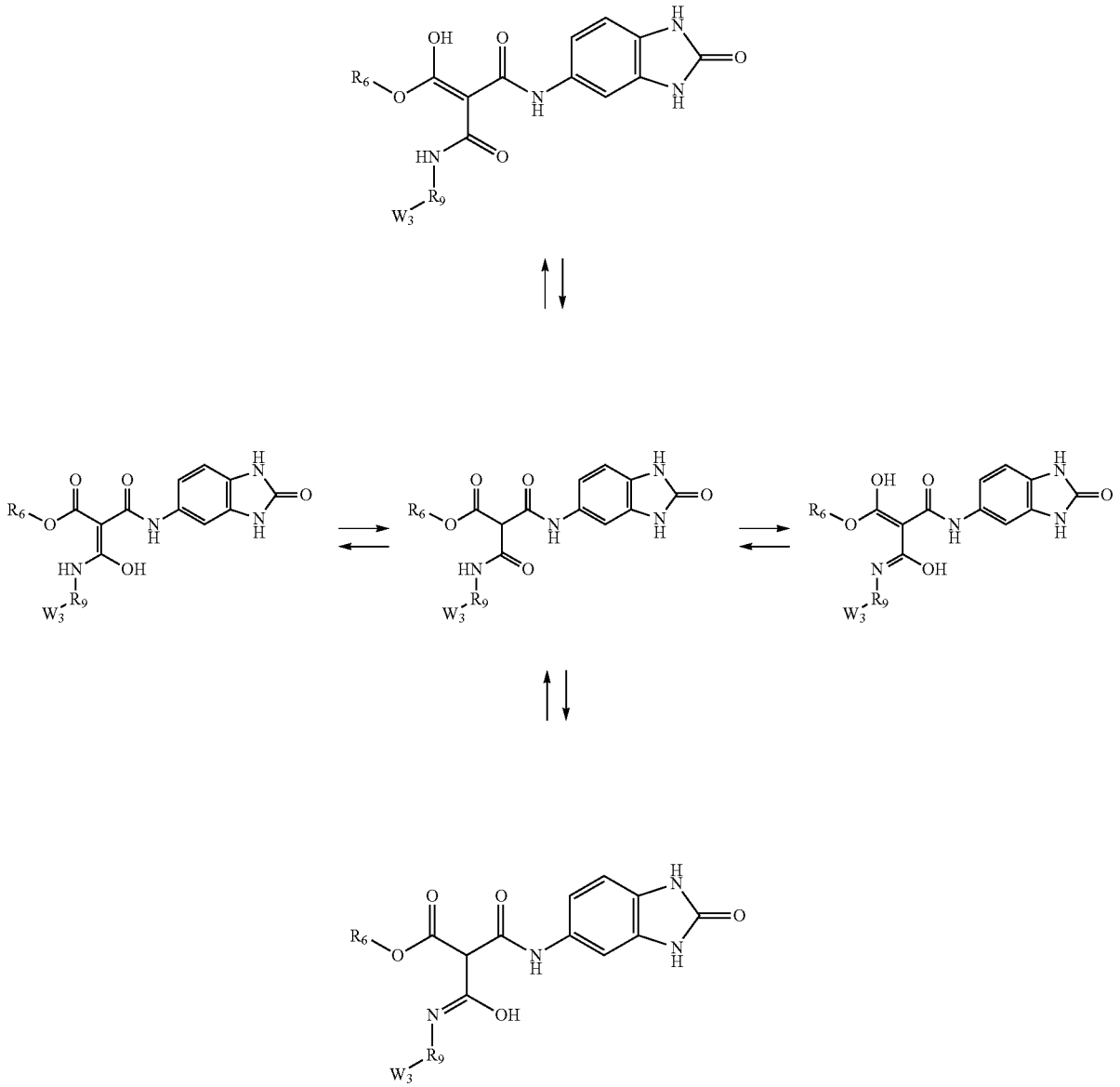
Examples of the structure represented by the formula (3) are shown below. However, the pigment adsorbing portion of the pigment dispersant used in aspects of the present invention is not limited thereto.
(4)
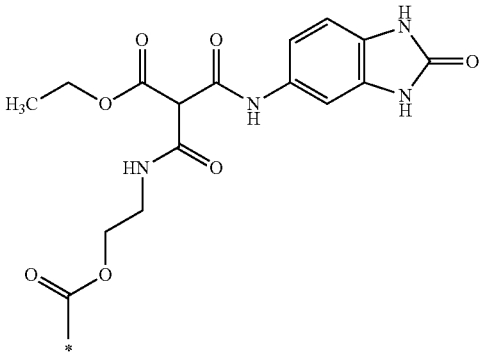
-continued
(5)
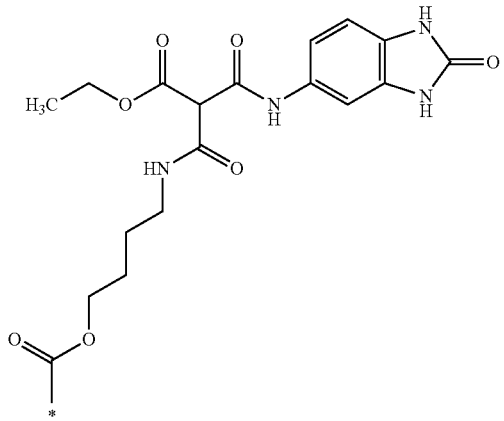

-continued (6)

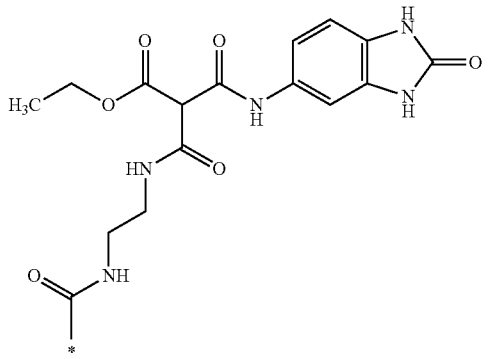

In the formulas (4) to (6), * indicates a bonding portion to the polymer moiety.

The pigment dispersant used in aspects of the present invention may use one type of structure (pigment adsorbing portion) represented by the formula (1) or at least two types thereof in combination.

Next, the polymer moiety bonded to W (linking group) of the structure represented by the formula (1) will be described. The polymer moiety functions as a dispersing portion. This polymer moiety is a polymer having affinity to the dispersion medium and is preferably obtained by using a highly common monomer. The polymer moiety preferably has a vinyl copolymer structure or a polyester structure, each of which is obtained by using at least one highly common monomer. When an appropriate monomer is arbitrarily selected from various types of monomers, the SP (solubility parameter) value of the polymer moiety may be made close to that of the medium, and the dispersion effect is likely to be obtained. In addition, in the case of the vinyl copolymer structure, a compound having an adsorbing portion preferably has a polymerizable functional group since manufacturing of the dispersant can be easily performed.

In the case in which the dispersing portion of the pigment dispersant of aspects of the present invention has a vinyl copolymer structure, the vinyl copolymer structure is preferably formed from at least one of an aromatic vinyl monomer, an acrylic acid-based monomer, and a methacrylic acid-based monomer.

As concrete examples of the aromatic vinyl monomer, for example, there may be mentioned styrene, vinyl toluene, and α-methyl styrene.

As concrete examples of the acrylic acid-based monomer, for example, there may be mentioned an acrylic acid, methyl acrylate, ethyl acrylate, propyl acrylate, butyl acrylate, 2-ethylhexyl acrylate, octyl acrylate, dodecyl acrylate, stearyl acrylate, behenyl acrylate, hydroxyethyl acrylate, hydroxypropyl acrylate, glycidyl acrylate, and benzyl acrylate. As concrete examples of the methacrylic acid-based monomer, for example, there may be mentioned an methacrylic acid, methyl methacrylate, ethyl methacrylate, propyl methacrylate, butyl methacrylate, 2-ethylhexyl methacrylate, octyl methacrylate, dodecyl methacrylate, stearyl methacrylate, behenyl methacrylate, hydroxyethyl methacrylate, hydroxypropyl methacrylate, glycidyl methacrylate, and benzyl methacrylate.

Those aromatic vinyl monomers, acrylic acid-based monomers, and methacrylic acid-based monomers may be used alone, or at least two types thereof may be used in combination, and an appropriate monomer may be selected therefrom in accordance with a medium to be used.

When the dispersing portion of the pigment dispersant used in aspects of the present invention has a polyester structure, the polyester structure has a unit derived from a polycarboxylic acid and a unit derived from a polyol. As the polycarboxylic acid, for example, there may be mentioned a dicarboxylic acid, such as oxalic acid, glutaric acid, succinic acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-carboxylic acid, hexahydroterephthalic acid, malonic acid, pimelic acid, phthalic acid, isophthalic acid, terephthalic acid, tetrachlorophthalic acid, chlorophthalic acid, nitrophthalic acid, (p-carboxyphenyl) acetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, or cyclohexanedicarboxylic acid. In addition, as other polycarboxylic acids other than the dicarboxylic acid, for example, there may be mentioned trimellitic acid, pyromellitic acid, naphthalenetricarboxylic acid, naphthalenetetracarboxylic acid, pyrenetricarboxylic acid, and pyrenetetracarboxylic acid.

As the polyol, for example, there may be mentioned ethylene glycol, diethylene glycol, triethylene glycole, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, poly(ethylene glycol), poly(propylene glycol), poly(tetramethylene glycol), sorbitol, 1,2,3,6-hexanetetrol, 1,4-sorbitan, pentaerythritol, dipentaerythritol, tripentaerythritol, 1,2,4-butantriol, 1,2,5-pentantriol, glycerol, 2-methylpropanetriol, 2-methyl-1,2,4-butanetriol, trimethylolethane, trimethylolpropane, 1,3,5-tris(hydroxymethyl)benzene, bisphenol A, bisphenol A ethylene oxide adduct, bisphenol A propylene oxide adduct, hydrogenated bisphenol A, hydrogenated bisphenol A ethylene oxide adduct, or hydrogenated bisphenol A propylene oxide adduct.

The monomers mentioned above may be used alone, or at least two types thereof may be used in combination, and the composition of the polymer may be appropriately selected in accordance with the dispersion medium.

In addition, as the dispersing portion, a hybrid polymer having a copolymer structure containing polyester segments and vinyl polymer segments may also be used. In particular, for example, a hybrid polymer in which vinyl polymer segments are grafted to a polyester main chain and a hybrid polymer in which polyester segments and vinyl polymer segments are bonded to form a block structure may be mentioned. In this case, the adsorbing portion (the structure represented by the formula (1)) may be bonded to either the polyester segment or the vinyl polymer segment. Next, a method for forming the pigment dispersant used in aspects of the present invention will be described. The pigment dispersant may be obtained by copolymerizing a compound in which a polymerizable functional group is introduced into a pigment adsorbing portion having the structure represented by the formula (1) and a monomer corresponding to the polymer moiety or by introducing the pigment adsorbing portion into a polymer moiety formed in advance by polymerization of a monomer corresponding thereto. In both the above methods, the formation may be performed by a related known synthesis method or polymerization method. For example, the synthesis may be performed in accordance with the following scheme.

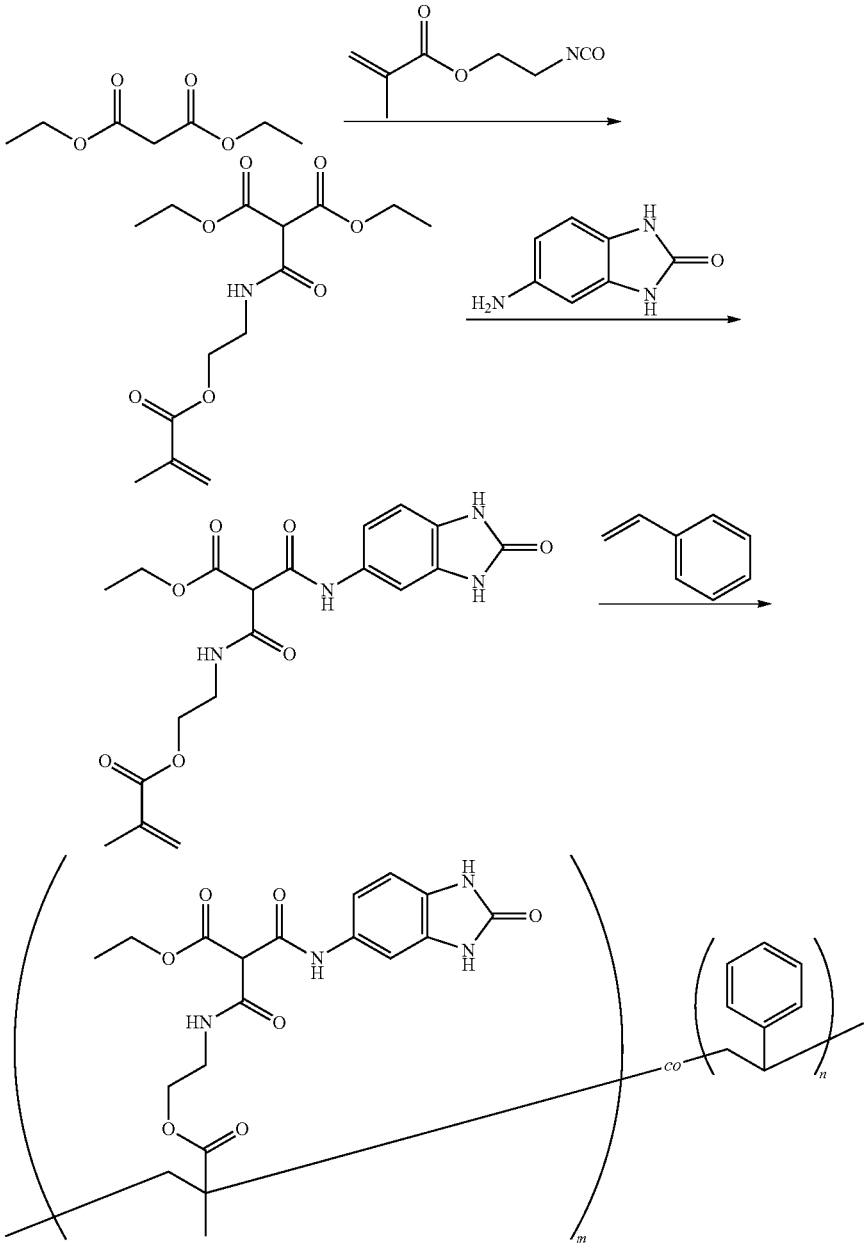

In the scheme described above, "—CO—" indicates a copolymer, and m and n each indicate the number of repeating structural units.

The pigment adsorbing portion of the above scheme into which the polymerizable functional group is introduced may be polymerized with a monomer corresponding to the polymer moiety by a related known method, such as radical polymerization, living radical polymerization, anion polymerization, or cation polymerization, to form the pigment dispersant. In the pigment dispersant, the pigment adsorbing portions and the polymer moieties may be present either in a random state or a block state.

The reaction temperature, the reaction time, and the types of solvent, catalyst, and the like, each of which is to be used in each step; the purification method after synthesis; and the like may be appropriately selected in accordance with a target product. The molecular structure of a synthesized adsorbing portion and the physical properties of a polymerized dispersant may be identified using a nuclear magnetic resonance apparatus (NMR), an infrared emission spectrophotometer (IR), a mass spectrometer (MS), a gel permeation chromatography (GPC), and the like.

The weight average molecular weight of the pigment dispersant used in aspects of the present invention is preferably 5,000 to 200,000. When the weight average molecular weight is 5,000 or more since the aggregation between pigment particles caused by the extruded volume effect can be suppressed, the coloring power is likely to be improved.

On the other hand, when the weight average molecular weight is 200,000 or less, since pigment particles are not likely to be cross-linked to each other with the pigment dispersant interposed therebetween, the coloring power is likely to be improved. The weight average molecular weight is more preferably 10,000 to 50,000. The weight average molecular weight of the pigment dispersant may be controlled by changing the temperature and/or the reaction time in polymerization.

The number of the pigment adsorbing portions (structure represented by the formula (1)) in the pigment dispersant is preferably 2 to 10 in one molecule of the pigment dispersant. When the number of the pigment adsorbing portions is 2 or more, since a sufficient amount of the adsorbing groups is able to adsorb to the pigment, the coloring power is likely to be improved. When the number of the pigment adsorbing portions is 10 or less, since the interaction between the adsorbing groups is suppressed, the coloring power is likely to be improved. The number of the pigment adsorbing portions is more preferably 3 to 8.

The content of the pigment dispersant used in aspects of the present invention is preferably 1.0 to 50.0 percent by mass with respect to the pigment. When the content is 1.0 percent by mass or more, since the adsorbing amount to the pigment is sufficient, the coloring power and charge buildup property are improved. When the content is 50.0 percent by mass or less, since the interaction between the pigment dispersant and the polar resin is suppressed, preferable charging property is obtained. The content of the pigment dispersant is more preferably 5.0 to 40.0 percent by mass with respect to the pigment.

Next, the polar resin used in aspects of the present invention will be described.

The acid value of the polar resin used in aspects of the present invention is 2.0 to 30.0 mgKOH/g. When the range described above is satisfied, a sufficient charging property can be obtained. Furthermore, the acid value of the polar resin is more preferably in a range of 5.0 to 20.0 mgKOH/g. When a polar resin in the range described above is used, a stabler charging property is likely to be obtained, and the durability is also likely to be improved. In addition, since the interaction between the pigment dispersant and the polar resin is also suppressed, the coloring power is also likely to be obtained.

As a polar resin having the acid value described above, for example, there may be mentioned a polyester resin, a vinyl resin, a polyamide resin, or a polyepoxy resin. Among those resins mentioned above, a common polyester resin or a common vinyl resin is preferable. As the vinyl resin, a styrene acrylic resin is preferable.

A method to control the acid value of the polar resin is changed in accordance with a resin to be used. When the polar resin is a polyester resin, the acid value may be controlled by adjusting the ratio between a divalent acid monomer and a divalent alcohol monomer, the molecular weights thereof, the amount of a trivalent acid monomer or a trivalent alcohol monomer, and the amount of a monovalent acid monomer or a monovalent alcohol monomer functioning as a terminating agent. In addition, when the polar resin is a styrene acrylic resin, which is one type of vinyl resin, the acid value may be controlled by adjusting the amount of a polymerizable monomer having a carboxy group or a sulfonic acid group.

The polyester resin described above may be obtained by condensation polymerization of a divalent acid (dicarboxylic acid) and a divalent alcohol (diol). A trivalent acid or alcohol or a monovalent acid or alcohol may also be used, if needed.

As the dicarboxylic acid, for example, there may be mentioned an alkane dicarboxylic acid, such as succinic acid, adipic acid, pimelic acid, suberic acid, azelaic acid, sebacic acid, decanedicarboxylic acid, dodecanedicarboxylic acid, octadecanedicarboxylic acid, decylsuccinic acid, dodecylsuccinic acid, or octadecylsuccinic acid; an alkene dicarboxylic acid, such as maleic acid, fumaric acid, citraconic acid, mesaconic acid, dodecenylsuccinic acid, pentadecenylsuccinic acid, octadecenylsuccinic acid, or a dimer acid; an aromatic dicarboxylic acid, such as phthalic acid, isophthalic acid, terephthalic acid, or naphthalenedicarboxylic acid; or a alicyclic dicarboxylic acid, such as 1,4-cyclohexanedicarboxylic acid, 1,3-cyclohexanedicarboxylic acid, or 1,2-cyclohexanedicarboxylic acid. Those compounds each may be used in the form of an anhydride or an alkyl ester.

As the trivalent acid, for example, there may be mentioned trimellitic acid, 1,3,5-cyclohexanetricarboxylic acid, or 1,2,4-cyclohexanetricarboxylic acid. Those compounds each may be used in the form of an anhydride or an alkyl ester.

As the divalent alcohol, for example, there may be mentioned an alkylene glycol, such as ethylene glycol, 1,2-propylene glycol, 1,4-butanediol, 1,5-pentanediol, or 1,6-hexanediol; an alkylene ether glycol, such as diethylene glycol, triethylene glycol, or dipropylene glycol; a bisphenol A, such as bisphenol A, bisphenol F, bisphenol S bisphenol A ethylene oxide (2 mol) adduct, or bisphenol A propylene oxide (2 mol) adduct; a cycloaliphatic diol, such as 1,4-cyclohexanediol, 1,2-cyclohexanediol, 1,3-cyclohexanediol, isosorbide, or spiroglycol.

Those carboxylic acid and alcohol components may be used alone, or at least two types thereof may be used in combination.

In addition, as the terminating agent to control the acid value of the polyester resin, a monovalent acid or alcohol may be mentioned. As the monovalent acid, for example, there may be mentioned acetic acid, propionic acid, butane acid, pentane acid, hexane acid, heptane acid, octane acid, nonane acid, decane acid, lauric acid, stearic acid, benzoic acid, or an anhydride thereof. As the monovalent alcohol, for example, there may be mentioned methanol, ethanol, propanol, butanol, pentanol, hexanol, heptanol, octanol, nonanol, decanol, lauryl alcohol, or stearyl alcohol.

For the condensation polymerization reaction of the polyester resin, in needed, an esterification catalyst, such as a known tin compound or titanium compound, may also be used.

When the polar resin is a styrene acrylic resin, the polar resin may be obtained by copolymerization of a monomer having a carboxy group or a sulfonic acid group on its side chain and a polymerizable monomer.

As the monomer having a carboxy group, for example, there may be mentioned, besides acrylic acid and methacrylic acid, a monomer having on its side chain, benzoic acid or its derivative, phthalic acid or its derivative, or salicylic acid or its derivative. In particular, related known monomers, such as the monomers disclosed in Japanese Patent Laid-Open No. 2014-98840, may be used. As the monomer having a sulfonic acid group on its side chain, a related known monomer, such as 2-acrylamide-2-methylpropanesulfonic acid, may be used.

As the polymerizable monomer to be copolymerized with the above monomer having a polar group, besides styrene, a common acrylic acid-based or methacrylic acid-based monomer, such as the aforementioned monomer which corresponds to the polymer moiety of the pigment dispersant, may also be used.

The content of the polar resin is preferably in a range of 0.1 to 30.0 percent by mass with respect to the total mass of the resin contained in the toner. When the content is in the range described above, a sufficient charging property can be obtained. In the range described above, since the charging property is more excellent, the content is more preferably in a range of 1.0 to 20.0 percent by mass. Furthermore, when the acid value of the polar resin is 10.0 mgKOH/g or less, the content thereof is preferably in a range of 4.0 to 20.0 mgKOH/g. In addition, when the acid value of the polar resin is more than 10.0 mgKOH/g, the content thereof is preferably in a range of 1.0 to 7.0 percent by mass. When the range described above is satisfied, the charging property and the coloring power are both likely to be improved, and at the same time, the durability is also likely to be improved. In addition, the polar resins may be used alone, or at least two types thereof may be used in combination.

The weight average molecular weight of the polar resin is preferably 5,000 to 100,000. When the above range is satisfied, a stable charging property is likely to be obtained.

In aspects of the present invention, as a resin component (binder resin) other than the polar resin, a known resin commonly used for the toner may be used. In particular, for example, a vinyl resin, a polyester resin, or a polyamide resin may be mentioned, and a vinyl resin is preferable. As the vinyl resin, for example, a styrene acrylic resin may be mentioned. As a monomer used to form a styrene acrylic resin, there may be mentioned a styrene-based monomer, such as styrene, α-methylstyrene, or divinyl benzene; an unsaturated carboxylic acid ester, such as methyl acrylate, butyl acrylate, methyl methacrylate, 2-hydroxyethyl methacrylate, t-butyl methacrylate, or 2-ethylhexyl methacrylate; an unsaturated carboxylic acid, such as acrylic acid or methacrylic acid; an unsaturated dicarboxylic acid, such as maleic acid; an unsaturated dicarboxylic anhydride, such as maleic anhydride; a nitrile-based vinyl monomer, such as acrylonitrile; a halogen-containing vinyl monomer, such as vinyl chloride; or a nitro-based vinyl monomer, such as nitrostyrene.

In addition, as a monomer used to form the polyester resin, the polycarboxylic acid and the polyol, which have been described in the case in which the polymer moiety of the pigment dispersant has a polyester structure, may be used.

As the pigment, for example, the following black pigment, yellow pigment, magenta pigment, and cyan pigment may be used.

As the black pigment, for example, carbon black may be mentioned.

As the yellow pigments, for example, compounds such as a condensation pigment, an isoindolinone compound, an anthraquinone compound, an azo metal complex methine compound, and an allylamide compound, may be mentioned. In more particular, for example, there may be mentioned C.I. Pigment Yellow 3, 7, 10, 12, 13, 14, 15, 17, 23, 24, 60, 62, 74, 75, 83, 93, 94, 95, 99, 100, 101, 104, 108, 109, 110, 111, 117, 123, 128, 129, 138, 139, 147, 148, 150, 155, 166, 168, 169, 177, 179, 180, 181, 183, 185, 191: 1, 191, 192, 193, and 199.

As the magenta pigments, for example, a condensation pigment, a diketo pyrrolo pyrrole compound, an anthraquinone compound, a guinacridone compound, a base dye lake compound, an naphthol compound, a benzimidazolon compound, a thioindigo compound, and a perylene compound may be mentioned. In more particular, for example, there may be mentioned C.I. Pigment Red 2, 3, 5, 6, 7, 23, 48: 2, 48: 3, 48: 4, 57: 1, 81: 1, 122, 146, 150, 166, 169, 177, 184, 185, 202, 206, 220, 221, 238, 254, 269, and C.I. Pigment Violet 19.

As the cyan pigments, for example, a phthalocyanine compound, a derivative thereof, an anthraquinone compound, and a base dye lake compound may be mentioned. In more particular, for example, there may be mentioned C.I. Pigment Blue 1, 7, 15, 15: 1, 15: 2, 15: 3, 15: 4, 60, 62, and 66.

The adsorbing rate of the pigment dispersant to the pigment is preferably 80.0% or more. The adsorbing rate is an adsorbing rate of the pigment dispersant to the pigment, as measured for a mixture obtained by mixing together 20 parts by mass of a solvent containing 16 parts by mass of styrene and 4 parts by mass of n-butyl acrylate, 0.1 parts by mass of the pigment dispersant, and 1.0 part by mass of the pigment. The detailed measurement conditions of the adsorbing rate will be described later. When the adsorbing rate is 80.0% or more, the pigment dispersibility is improved, and the coloring power is improved. In addition, since the pigment is reliably covered with the dispersant, the charge buildup property is improved, and since the interaction between the pigment and the polar resin is suppressed, the durability is also likely to be improved. Those pigments may be used alone, or at least two types thereof may be used in combination.

In the toner of aspects of the present invention, a release agent may be further contained in the toner particles. For example, as the release agent, there may be mentioned an ester wax having one ester bond, such as behenyl behenate, stearyl stearate, or palmityl palmitate; an ester wax having two ester bonds, such as dibehenyl sebacate or hexanediol dibehenate; an ester wax having three ester bonds, such as glycerin tribehenate; an ester wax having four ester bonds, such as pentaerythritol tetrastearate or pentaerythritol tetrapalmitate; an ester wax having six ester bonds, such as dipentaerythritol hexastearate or dipentaerythritol hexapalmitate; a polyfunctional ester wax such as polyglycerine behenate; a natural ester wax, such as a carnauba wax or a rice wax; a petroleum wax and a derivative thereof, such as a paraffin wax, a microcrystalline wax, or a petrolatum; a hydrocarbon wax and a derivative thereof by a Fischer-Tropsch method; a polyolefin wax and a derivative thereof, such as a polyethylene wax or a polypropylene wax; a higher aliphatic alcohol; a fatty acid, such as stearic acid or palmitic acid; or an acid amide wax.

When the content of the release agent is 1 to 30 parts by mass with respect to 100 parts by mass of the resin, the release property of the toner is preferably improved.

In the toner of aspects of the present invention, a charge control agent may be further contained in the toner particles. As the charge control agent used for the toner of aspects of the present invention, a related known charge control agent may be used. As a negative charge control agent, for example, there may be mentioned a metal compound of an aromatic carboxylic acid, such as salicylic acid, an alkylsalicylic acid, a dialkylsalicylic acid, naphthoic acid, or a dicarboxylic acid; a polymer or a copolymer having a sulfonic acid group, a sulfonic acid salt group, or a sulfonic acid ester group; a metal salt or a metal complex of an azo dye or an azo pigment; a boron compound, a silicon compound, or a calixarene. In addition, as a positive charge control agent, for example, there may be mentioned a quaternary ammonium salt, a high molecular weight compound having a quaternary ammonium salt on its side chain, a guanidine compound, a nigrosine compound, or an imidazole compound.

As the polymer or the copolymer having a sulfonic acid salt group or a sulfonic acid ester group, there may be used a homopolymer formed from a vinyl monomer containing a sulfonic acid group, such as styrene sulfonic acid, 2-acrylamide-2-methylpropane sulfonic acid, 2-methacrylamide-2-methylpropane sulfonic acid, vinyl sulfonic acid, or methacrylic sulfonic acid or a copolymer formed from a vinyl monomer and the above vinyl monomer containing a sulfonic acid group.

The content of the charge control agent is preferably 0.01 to 5 parts by mass with respect to 100 parts by mass of the resin.

In order to improve the fluidity of the toner, the toner of aspects of the present invention may also contain an external additive. As the external additive, a related known external additive may be used. For example, there may be mentioned raw silica fine particles, such as a wet method silica or a fume method silica, or silica fine particles obtained, by performing a surface treatment of the above raw silica fine particles with a treatment agent, such as a silane coupling agent, a titanium coupling agent, or a silicone oil; metal oxide fine particles, such as titanium oxide fine particles, aluminum oxide fine particles, or zinc oxide fine particles, or metal oxide fine particles obtained by performing a hydrophobizing treatment on a metal oxide; a fatty acid metal salt, such as zinc stearate, calcium stearate, or zinc stearate; a metal complex of an aromatic carboxylic acid, such as salicylic acid, an alkylsalicylic acid, a dialkylsalicylic acid, naphthoic acid, or a dicarboxylic acid; fine particles of a clay mineral, such as a hydrotalcite; or fluorinated resin fine particles, such as poly(vinylidene fluoride) fine particles or polytetrafluoroethylene fine particles. Among those mentioned above, since being excellent in fluidity and friction charging property, silica particles obtained by performing a surface treatment on raw silica fine particles with the above treatment agent are preferably used.

The addition amount of the external additive is preferably 0.1 to 5.0 parts by mass with respect to 100 parts by mass of the toner particles.

As a method for manufacturing the toner particles, any manufacturing method may be use. For example, there may be used a suspension polymerization method in which a solution containing a polymerizable monomer to form a resin, a polar resin, a pigment, a pigment dispersant, and the like is suspended in an aqueous solvent and is then polymerized; a kneading and pulverizing method in which various types of toner forming materials, such as a resin, a polar resin, a pigment, and a pigment dispersant, are kneaded, pulverized, and sieved; an emulsion aggregation method in which a dispersion liquid in which a resin and a polar resin are emulsified and a dispersion liquid of a pigment, a pigment dispersant, and the like are mixed together, aggregated, and thermally fused to obtain toner particles; an emulsion polymerization aggregation method in which a dispersion liquid formed by emulsion polymerization of a polymerizable monomer and a dispersion liquid of a polar resin, a pigment, a pigment dispersant, and the like are mixed together, aggregated, and thermally fused to obtain toner particles; and a dissolution suspension method in which a solution containing a resin, a polar resin, a pigment, a pigment dispersant, and the like is suspended in an aqueous solvent for granulation.

Among those methods described above, the method for manufacturing a toner of aspects of the present invention preferably includes a step of obtaining toner particles by forming particles in an aqueous medium. Furthermore, a suspension polymerization method and a dissolution suspension method are preferable. When particles are formed in an aqueous medium, since the polar resin is likely to be unevenly distributed on the surface layers of the toner particles, the charging property and the durability are likely to be improved.

As the polymerizable monomer used when the toner particles are obtained by a suspension polymerization method, as described above, a styrene-based monomer, an unsaturated carboxylic acid ester, an unsaturated carboxylic acid, an unsaturated dicarboxylic acid, an unsaturated dicarboxylic acid anhydride, a nitrile-based vinyl monomer, a halogen-containing vinyl monomer, and a nitro-based vinyl monomer may be mentioned.

When the toner particles are obtained by a suspension polymerization method, a polymerization initiator may be further used. As the polymerization initiator, a known polymerization initiator may be used. For example, there may be mentioned an azo or a diazo polymerization initiator, such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, or an azobisisobutyronitrile derivative; or a peroxide polymerization initiator, such as benzoyl peroxide, t-butyl peroxy-2-ethylhexanoate, 1,1,3,3-tetramethylbutyl peroxy-2-ethylhexanoate, t-butyl peroxy pivalate, t-butyl peroxy isobutyrate, t-butyl peroxy neodecanoate, methyl ethyl ketone peroxide, diisopropyl peroxy carbonate, cumen hydroperoxide, 2,4-dichlorobenzoyl peroxide, or lauroyl peroxide.

When one toner particles are obtained by a suspension polymerization method, known chain transfer agent and polymerization inhibitor may also be used.

When the toner particles are obtained by a suspension polymerization method, an inorganic or an organic dispersion stabilizer may be further contained in the aqueous medium. As the dispersion stabilizer, a known dispersion stabilizer may be used. As the inorganic dispersion stabilizer, for example, there may be mentioned a phosphoric acid salt, such as a hydroxyapatite, tribasic calcium phosphate, dibasic calcium phosphate, magnesium phosphate, aluminum phosphate, or zinc phosphate; a carbonate salt, such as calcium carbonate or magnesium carbonate; a metal hydroxide, such as calcium hydroxide, magnesium hydroxide, or aluminum hydroxide; a sulfuric acid salt, such as calcium sulfate or barium sulfate; calcium metasilicate; bentonite; silica; or alumina. In addition, as the organic dispersion stabilizer, for example, there may be mentioned a sodium salt of a poly(vinyl alcohol), a gelatin, a methyl cellulose, a methyl hydroxypropyl cellulose, an ethyl cellulose, or a carboxymethyl cellulose; a poly(acrylic acid) or a salt thereof; or a starch.

As the dispersion stabilizer, when an inorganic compound is used, although a commercially available product may be used without any additional treatment, in order to obtain finer particles, the inorganic compound described above may be formed in an aqueous medium. For example, in the case of calcium phosphate, such as a hydroxyapatite or tribasic calcium phosphate, an aqueous solution of a phosphoric acid salt and an aqueous solution of a calcium salt may be mixed together by vigorous stirring.

When the toner particles are obtained by a suspension polymerization method, a surfactant may be further contained in the aqueous medium. As the surfactant, a known surfactant may be used. For example, there may be mentioned an anionic surfactant, such as dodecylbenzene sodium sulfate or sodium oleate; a cationic surfactant; an ampholytic surfactant; or a nonionic surfactant may be mentioned.

As an organic solvent used when the toner particles are obtained by a dissolution suspension method, a solvent which is not well mixed with water and which can be easily removed by temperature increase is preferable. For example, ethyl acetate may be mentioned.

When the toner particles are obtained by a dissolution suspension method, an inorganic or an organic dispersion stabilizer may be further contained in the aqueous medium. As the dispersion stabilizer, the dispersion stabilizer described in the above suspension polymerization method may be used.

Hereinafter, measurement methods of various physical properties relating to aspects of the present invention will be described.

<Measurement Method of Adsorbing Rate of Pigment Dispersant to Pigment>

(1) In a pressure-proof bottle having a volume of 50 ml, 1.0 g of a pigment, 0.10 g of a pigment dispersant, 16.0 g of styrene, 4.0 g of n-butyl acrylate, and 30.0 g of glass beads (diameter: 0.8 mm) are accurately weighed and then mixed together.

(2) Shaking is performed for 3 hours using a paint shaker (manufactured by Toyo Seiki Co., Ltd.).

(3) After the shaking, the mixture thus obtained is processed by a centrifugal machine (mini spin plus, manufactured by Eppendorf, 14.5 krpm, for 30 minutes), and a supernatant is obtained.

(4) The supernatant thus obtained is filtrated using Millex LH0.45 μm (manufactured by Nippon Millipore Kogyo K.K.), and a filtrate is analyzed by a gel permeation chromatography (GPC). The analysis conditions of GPC are in accordance with the measurement method of the weight average molecular weight am which will be described later. The peak area of the chart obtained thereby is represented by B1 (vertical axis: electric intensity dependent on the concentration, horizontal axis: retention time).

(5) By a method similar to that described above, after 0.10 g of a pigment dispersant, 16.0 g of styrene, 4.0 g of n-butyl acrylate are accurately weighed and then mixed together, the solution thus obtained is filtrated, and a filtrate obtained thereby is analyzed by GPC. The peak area of the chart obtained thereby is represented by B2. In addition, in order to obtain an area ratio of B1 to B2, the vertical axis and the horizontal axis of the chart used to obtain the peak area B1 each have the same reduction scale as that of the chart used to obtain the peak area B2.

(6) Based on the following formula, the adsorbing rate of the pigment dispersant to the pigment is calculated.

$$\text{Adsorbing rate (\%)}=(1-B1/B2)\times 100$$

<Acid Value Measurement of Polar Resin>

The acid value is measured in accordance with the measurement method of JIS K0070-1992. The acid value represents the weight (mg) of potassium hydroxide (KOH) required to neutralize the acid contained in 1 g of a sample.

After 2.00 g of a sample is accurately weighed (S(g)), the sample is dissolved in 100 ml of a mixed liquid of toluene/ethanol (2:1). One droplet of a phenolphthalein solution is added as an indicator, and titration is performed using a KOH (ethanol) solution at a concentration of 0.1 mol/L. The amount thereof used for the titration is represented by B (ml).

A titration similar to that described above is performed using only a mixed liquid of toluene/ethanol (2:1), and the amount used for the titration is represented by C (ml).

The acid value is calculated by the following formula. In addition, "f" in the formula indicates the factor of the KOH (ethanol) solution.

$$\text{Acid value (mgKOH/g)}=[(B-C)\times f\times 5.61]/S$$

<Structural Analysis of Pigment Dispersant and Polar Resin>

The structure determination of the pigment dispersant and the polar resin is performed by a nuclear magnetic resonance analysis (H-NMR).

Measurement apparatus: JNM-EX400 (manufactured by JEOL Ltd.)

Measurement frequency: 400 MHz

Pulse condition: 5.0 μs

Frequency range: 10,500 Hz

Accumulation number: 64 times

Measurement solvent: $CDCl_3$ or DMF-d7

<Measurement Methods of Weight Average Molecular Weight and Number Average Molecular Weight of Pigment Dispersant and Polar Resin>

The weight average molecular weight (Mw) and the number average molecular weight (Mn) are measured as described below using a gel permeation chromatography (GPC).

First, the pigment dispersant or the polar resin is dissolved in tetrahydrofuran (THF) at room temperature. In addition, the solution thus obtained is filtrated using a solvent resistant membrane filter "My Process Disk" (manufactured by Tosoh Corp.) having a pore diameter of 0.2 μm, so that a sample solution is obtained. In addition, the sample solution is adjusted so that a component soluble in THF has a concentration of 0.8 percent by mass. By the use of this sample solution, the measurement is performed under the following conditions.

Apparatus: high speed GPC apparatus "HLC-8220GPC" manufactured by Tosoh Corporation.

Columns: two LE-604 in series (manufactured by Showa Denko K.K.)

Fluent: THF

Flow Late: 0.6 mL/min

Oven temperature: 40° C.

Sample injection amount: 0.020 ml

In order to calculate the molecular weight of the sample, a molecular weight calibration curve formed by using standard polystyrene resins (such as trade name "TSK Standard Polystyrene F-850, F-450, F-288, F-128, F-80, F-40, F-20, F-10, F-4, F-2, F-1, A-5000, A-2500, A-1000, A-500" manufactured by Tosoh Corp.) is used.

EXAMPLES

Hereinafter, although aspects of the present invention will be described in detail with reference to examples, aspects of the present invention are not limited thereto. In the following description, "part(s)" and "1" are each on the mass base unless otherwise particularly noted.

<Synthesis of Pigment Dispersant>

First, pigment adsorbing portions (A1) to (A10) having the structures shown in the following Table 1 and a pigment adsorbing portion (A11) used for a comparative example were synthesized.

TABLE 1

| Pigment Adsorbing Portion (Formula (1)) | x | y | z | $R_1$ | $R_2$ | $R_3$ | W |
|---|---|---|---|---|---|---|---|
| A1 | —NH— | —O— | —NH— | Benzimidazolinone | $—CH_2CH_3$ | $—(CH_2)_2—$ | —COO— |
| A2 | —NH— | —O— | —NH— | Phenylureido | $—CH_2CH_3$ | $—(CH_2)_2—$ | —COO— |
| A3 | —NH— | —O— | —NH— | Benzimidazolinone | $—CH_2CH_3$ | $—(CH_2)_2—$ | —CONH— |
| A4 | —NH— | —NH— | —NH— | Benzimidazolinone | $—(CH_2)_3CH_3$ | $—(CH_2)_2—$ | —COO— |
| A5 | —NH— | —NH— | —NH— | Benzimidazolinone | Benzimidazolinone | $—(CH_2)_2—$ | —COO— |
| A6 | —NH— | —O— | —NH— | Benzimidazolinone | $—CH_2CH_3$ | $—(CH_2)_4—$ | —COO— |
| A7 | —O— | —O— | —NH— | Benzimidazolinone | $—CH_2CH_3$ | $—(CH_2)_2—$ | —COO— |
| A8 | —NH— | —O— | —O— | Benzimidazolinone | $—CH_2CH_3$ | $—(CH_2)_2—$ | —COO— |
| A9 | $—N(CH_3)—$ | $—N(CH_3)—$ | $—N(CH_3)—$ | Phenyl | $—(CH_2)_3CH_3$ | $—(CH_2)_2—$ | —COO— |
| A10 | —NH— | —O— | —NH— | Anthraquinone | $—CH_2CH_3$ | $—(CH_2)_2—$ | —COO— |

<Synthesis of Pigment Adsorbing Portion (A1)>

In accordance with the following synthesis scheme, the pigment adsorbing portion (A1) was synthesized.

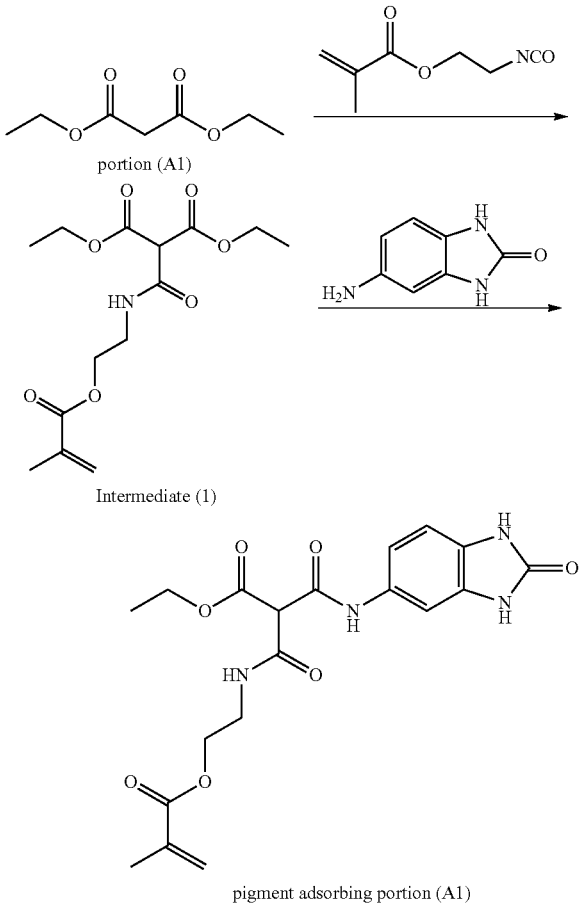

(Synthesis of Intermediate (1))

With reference to the description of the synthesis example 1 of Japanese Patent Laid-Open No. 10-316643, an intermediate (1) was synthesized. In particular, 20.6 parts (0.129 moles) of diethyl malonate, 19.8 parts (0.128 moles) of 2-methacryloyloxyethyl isocyanate (trade name "Karenz MOI" manufactured by Showa Denko K.K.), and 0.284 parts (1.29 millimoles) of 2,6-di-tert-butyl-p-cresol were dissolved in 100 parts (0.942 moles) of xylene and were then heated to 60° C. After 0.214 parts (3.96 millimoles) of sodium methoxide was charged and allowed to react for 8 hours, 200 parts (11.1 moles) of water was charged to stop the reaction. After an organic layer was extracted with toluene and concentrated, the residue thus obtained was crystallized using toluene, so that the intermediate (1) was obtained.

(Synthesis of Pigment Adsorbing Portion (A1))

After 19.8 parts (62.6 millimoles) of the intermediate (1), 11.4 parts (76.4 millimoles) of 5-amino-2-benzimidazolinone, and 0.138 parts (0.626 millimoles) of 2,6-di-tert-butyl-p-cresol were dissolved in 141 parts (1.93 moles) of N,N-dimethylformamide, heating and stirring were performed at 80° C. for 6 hours for reaction. After the reaction was completed, N,N-dimethylformamide was distilled off at a reduced pressure, and 300 parts (16.7 moles) of water was charged to the residue thus obtained. A precipitate was filtrated, so that the pigment adsorbing portion (A1) was obtained.

(Synthesis of Pigment Adsorbing Portion (A2))

In accordance with the following scheme, the pigment adsorbing portion (A2) was synthesized.

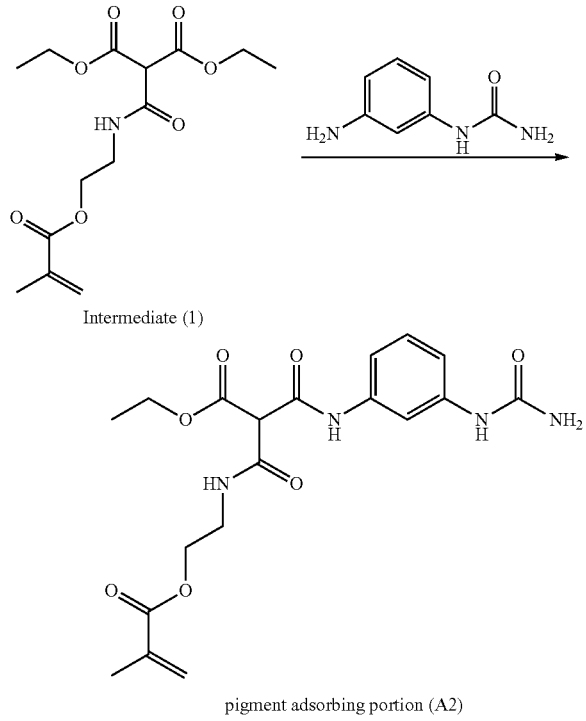

In the synthesis of the pigment adsorbing portion (A1), except that 5-amino-2-benzimidazolinone was changed to 3-aminophenylureido, the pigment adsorbing portion (A2) was synthesized by a method similar to that of the synthesis of the pigment adsorbing portion (A1).

(Synthesis of Pigment Adsorbing Portion (A3))

In accordance with the following synthesis scheme, the pigment adsorbing portion (A3) was synthesized.

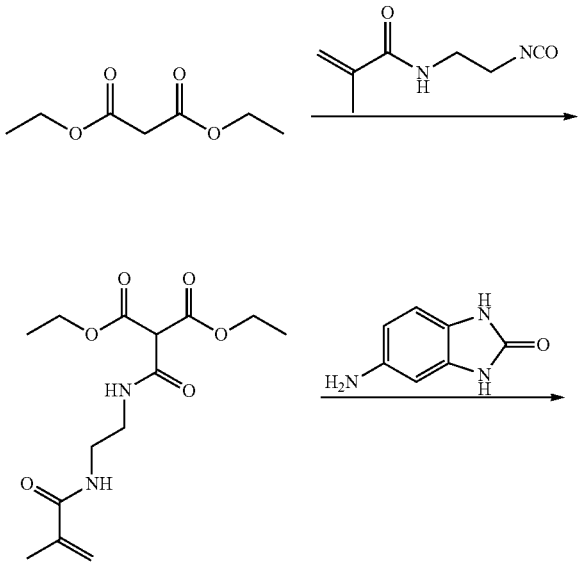

Intermediate (2)

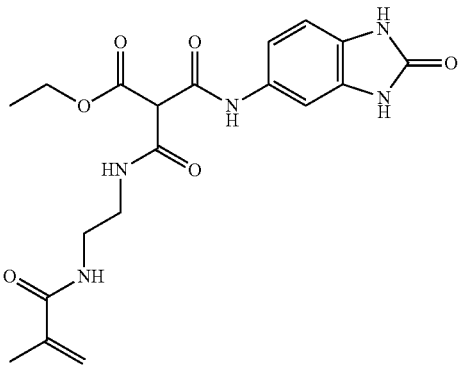

pigment adsorbing portion (A3)

In the synthesis of the intermediate (1), except that 2-methacryloyloxyethyl isocyanate was changed to 2-methacryloylaminoethyl isocyanate, an intermediate (2) was synthesized by a method similar to that of the synthesis of the intermediate (1). Except that the intermediate (1) for the synthesis of the pigment adsorbing portion (A1) was changed to the intermediate (2), the pigment adsorbing portion (A3) was synthesized by a method similar to that of the synthesis of the pigment adsorbing portion (A1)

(Synthesis of Pigment Adsorbing Portion (A4))

In accordance with the following synthesis scheme, the pigment adsorbing portion (A4) was synthesized.

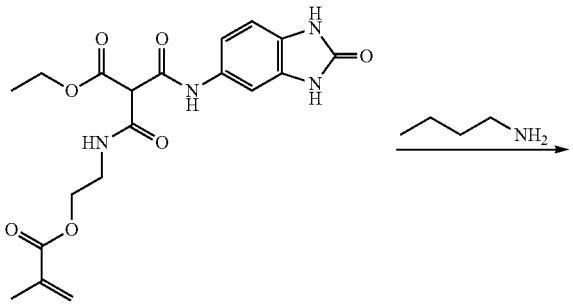

pigment adsorbing portion (1)

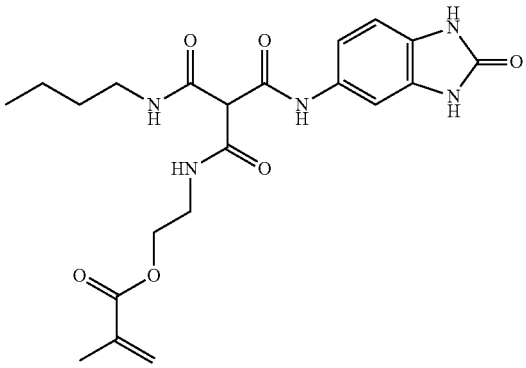

pigment adsorbing portion (A4)

After 20.0 parts (47.8 millimoles) of the pigment adsorbing portion (A1), 60.0 parts (0.821 moles) of N,N-dimethylformamide, 0.105 parts (0.478 millimoles) of 2,6-di-tert-butyl-p-cresol, and 17.5 parts (0.239 moles) of N-butylamine were mixed together, heating and stirring were performed at 80° C. for 6 hours for reaction. After the reaction was completed, N,N-dimethylformamide was distilled off at a reduced pressure, and 300 parts (16.7 moles) of water was charged to the residue thus obtained. A precipitate was filtrated, so that the pigment adsorbing portion (A4) was obtained.

(Synthesis of Pigment Adsorbing Portion (A5))

In accordance with the following scheme, the pigment adsorbing portion (A5) was synthesized.

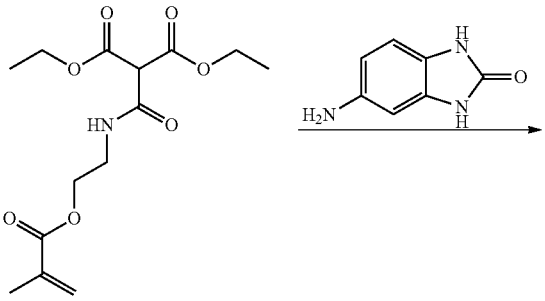

Intermediate (1)

-continued

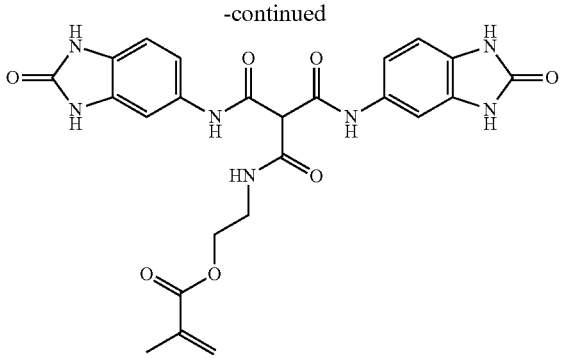

pigment adsorbing portion (A5)

In the synthesis of the pigment adsorbing portion (A1), except that the addition amount of 5-amino-2-benzimidazolinone was increased twice, and the reaction time was changed to 16 hours, the pigment adsorbing portion (A5) was synthesized by a method similar to that of the synthesis of the pigment adsorbing portion (A1).

(Synthesis of Pigment Adsorbing Portion (A6))

In accordance with the following scheme, the pigment adsorbing portion (A6) was synthesized.

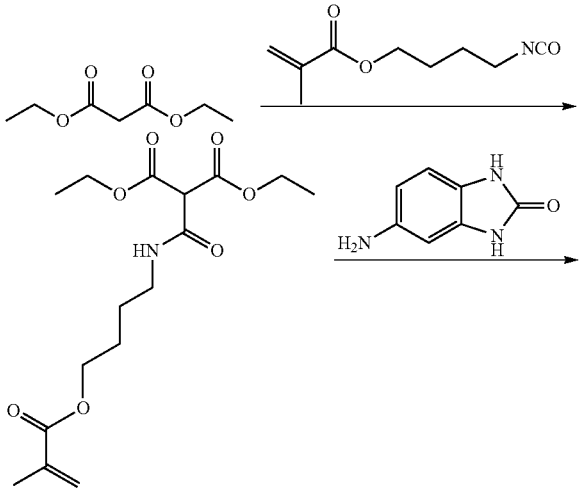

Intermediate (3)

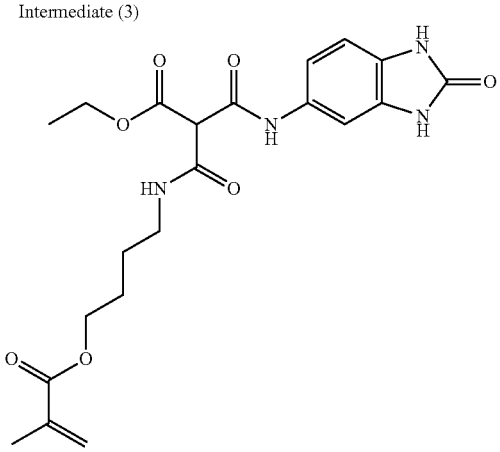

pigment adsorbing portion (A 6)

In the synthesis of the intermediate (1), except that 2-methacryloyloxyethyl isocyanate was changed to 4-methacryloyloxybutyl isocyanate, an intermediate (3) was synthesized by a method similar to that of the synthesis of the intermediate (1). Except that in the synthesis of the pigment adsorbing portion (A1), the intermediate (1) was changed to the intermediate (3), the pigment adsorbing portion (A6) was synthesized by a method similar to that of the synthesis of the pigment adsorbing portion (A1).

(Synthesis of Pigment Adsorbing Portion (A7))

In accordance with the following scheme, the pigment adsorbing portion (A7) was synthesized.

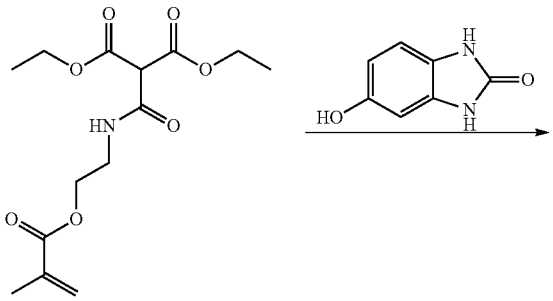

Intermediate (1)

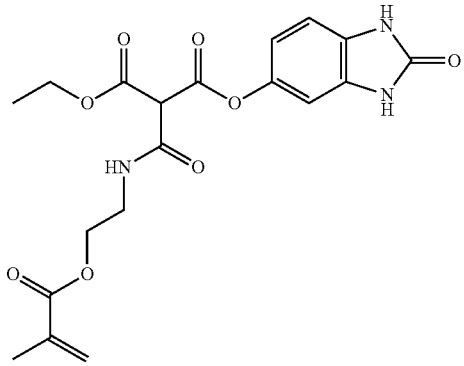

pigment adsorbing portion (A7)

In the synthesis of the pigment adsorbing portion (A1), except that 5-amino-2-benzimidazoline was changed to 5-hydroxy-2-benzimidazolinone, the pigment adsorbing portion (A7) was synthesized by a method similar to that of the synthesis of the pigment adsorbing portion (A1).

(Synthesis of Pigment Adsorbing Portion (A8))

In accordance with the following scheme, the pigment adsorbing portion (A8) was synthesized.

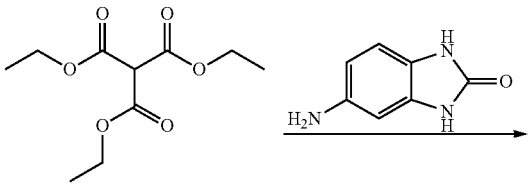

-continued

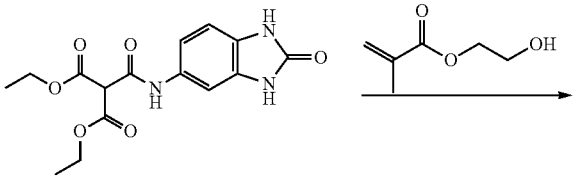

Intermediate (4)

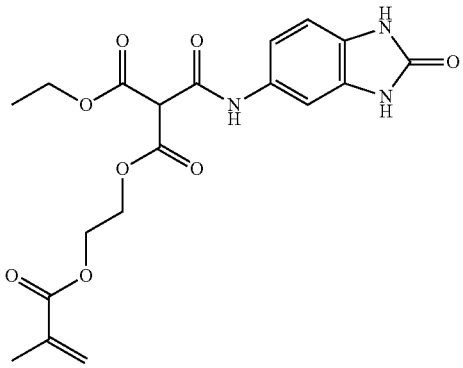

pigment adsorbing portion (A8)

After 14.5 parts (62.4 millimoles) of triethyl carboxymalonate, 11.4 parts (76.4 millimoles) of 5-amino-2-benzimidazolinone, and 0.138 parts (0.626 millimoles) of 2,6-di-tert-butyl-p-cresol were dissolved in 141 parts (1.93 moles) of N,N-dimethylformamide, heating and stirring were performed at 80° C. for 6 hours for reaction. After the reaction was completed, N,N-dimethylformamide was distilled off at a reduced pressure, and 300 parts (16.7 moles) of water was charged to the residue thus obtained. A precipitate was filtrated, so that an intermediate (4) was obtained.

After 18.8 parts (56.1 millimoles) of the intermediate (4), 50.0 parts (0.684 moles) of N,N-dimethylformamide, and 0.124 parts (0.563 millimoles) of 2,6-di-tert-butyl-p-cresol, and 21.9 parts (0.168 moles) of 2-hydroxyethyl methacrylate were mixed together, heating and stirring were performed at 80° C. for 10 hours for reaction. After the reaction was completed, N,N-dimethylformamide was distilled off at a reduced pressure, and 3:00 parts (16.7 moles) of water was charged to the residue thus obtained. A precipitate was filtrated, so that the pigment adsorbing portion (A8) was obtained.

(Synthesis of Pigment Adsorbing Portion (A9))

In accordance with the following scheme, the pigment adsorbing portion (A9) was synthesized.

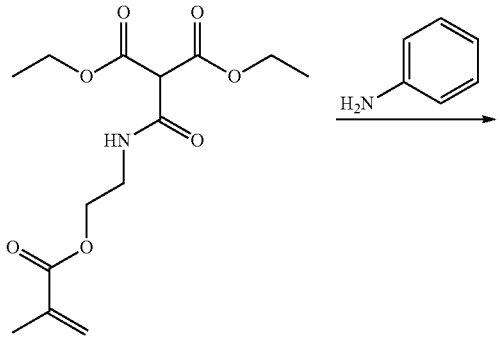

Intermediate (1)

-continued

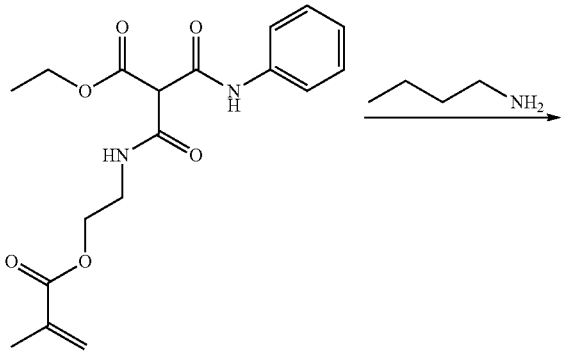

Intermediate (5)

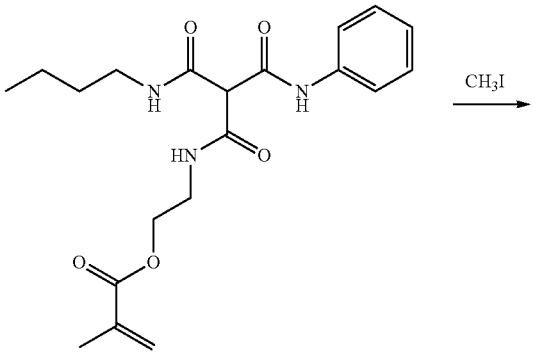

Intermediate (6)

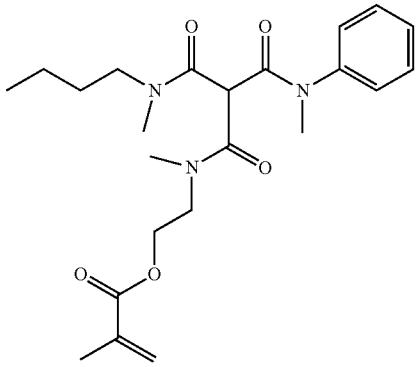

pigment adsorbing portion (A9)

In the synthesis of the pigment adsorbing portion (A1), except that 5-amino-2-benzimidazolinone was changed to aniline, an intermediate (5) was synthesized by a method similar to that of the synthesis of the pigment adsorbing portion (A1). Furthermore, in the synthesis of the pigment adsorbing portion (A4), except that the pigment adsorbing portion (1) was changed to the intermediate (5), an intermediate (6) was obtained by a method similar to that of the synthesis of the pigment adsorbing portion (A4).

After 19.0 parts (48.8 millimoles) of the intermediate (6) and 67.4 parts (0.488 moles) of potassium carbonate were dissolved in 141 parts (1.93 moles) of N,N-dimethylformamide, 41.6 parts (0.293 moles) of iodomethane was dripped to the mixture thus obtained while cooling was performed with ice. Subsequently, the reaction liquid was heated to 60° C. and was then allowed to react at 40° C. for 6 hours by heating and stirring. After the reaction was completed, N,N-dimethylformamide was distilled off at a reduce pressure, and 200 parts (11.1 moles) of water and 200 parts (1.68 moles) of chloroform were charged to the residue obtained, thereby. Next, liquid separation of this mixture was performed, and a target product was extracted in an organic layer. After washed with water, the organic layer was dried with magnesium sulfate and then concentrated, so that the pigment adsorbing portion (A9) was obtained.

(Synthesis of Pigment Adsorbing Portion (A10))

In accordance with the following scheme, the pigment adsorbing portion (A10) was synthesized.

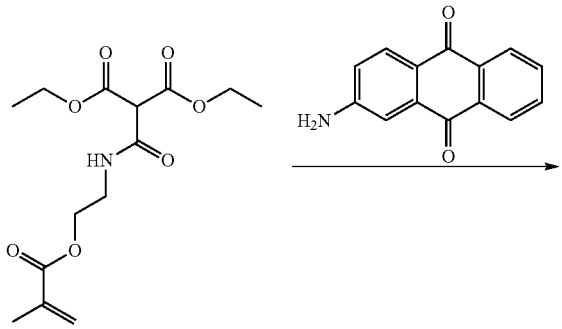

Intermediate (1)

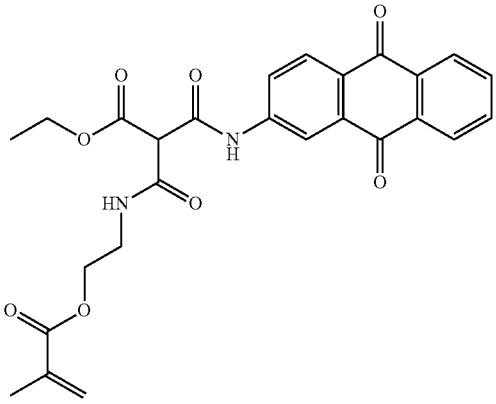

pigment adsorbing portion (A10)

In the synthesis of the pigment adsorbing portion (A1), except that 5-amino-2-benzimidazolinone was changed to aminoanthraquinone, the pigment adsorbing portion (A10) was synthesized by a method similar to that of the synthesis of the pigment adsorbing portion (A1).

(Synthesis of Pigment Adsorbing Portion (A11))

With reference to the description of the synthesis example 1 disclosed in Japanese Patent Laid-Open No. 2003-238837, the pigment adsorbing portion (A11) was synthesized in accordance with the following scheme.

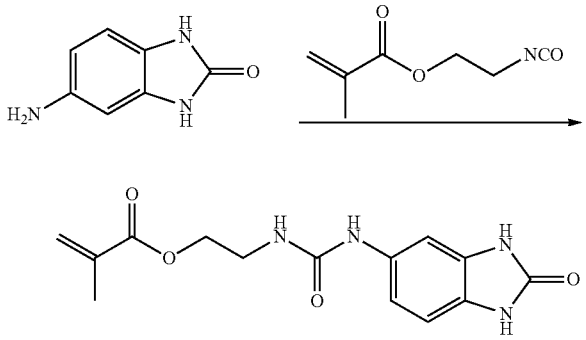

pigment adsorbing portion (A11)

After 11.4 parts (76.4 millimoles) of 5-amino-2-benzimidazolinone was dissolved in 50.0 parts (0.684 moles) of N,N-dimethylformamide, the solution thus obtained was cooled to 5° C. After 11.9 parts (76.7 millimoles) of 2-methacryloyloxyethyl isocyanate (trade name "Karenz MOI", manufactured by Showa Denko K.K.) was dripped to the solution described above, the reaction liquid thus prepared was stirred at room temperature for 30 minutes. After the reaction was completed, N,N-dimethylformamide was distilled off at a reduced pressure, and 100 parts (5.56 moles) of water was charged to the residue thus obtained. A precipitate was filtrated, so that the pigment adsorbing portion (A11) was obtained.

Next, by the use of the pigment adsorbing portions (A1) to (A11), pigment dispersants S1 to 319 and a pigment dispersant 320 used for the comparative example were synthesized.

(Synthesis of Pigment Dispersant S1)

After 58.6 parts (0.563 moles) of styrene, 10.5 parts (25.0 millimoles of the pigment adsorbing portion (A1), 12.7 parts (37.5 millimoles) of stearyl methacrylate, 150.0 parts (2.05 moles) of N,N-dimethylformamide, and 1.37 parts (8.33 millimoles of azobisisobutyronitrile were charged into an eggplant flack purged with nitrogen, stirring was performed at 80° C. Polymerization was performed while the molecular weight was monitored by GPC, and when the molecular weight reached a desired value, the reaction was stopped by cooling with ice water, so that the pigment dispersant S1 was obtained.

After the pigment dispersant S1 thus obtained was purified by solid-liquid separation in methanol which was a poor solvent, the molecular weight and the molecular composition of the pigment dispersant S1 were analyzed by NMR and GPC. The analytical results are shown in Table 2.

(Synthesis of Pigment Dispersants S2 to S20)

Except that in accordance with the composition shown in Table 2, the type of monomer to be used and the amount thereof were each appropriately changed, the pigment dispersants S2 to S20 were each synthesized by a method similar to that of the pigment dispersant S1 described above. The analytical results of the molecular weight and the molecular composition of each pigment dispersant thus synthesized are shown in Table 2.

TABLE 2

| | Charge Composition (Molar Ratio in One Molecule of Pigment Dispersant) | | | | Analytical Result | | | | |
|---|---|---|---|---|---|---|---|---|---|
| | Styrene | Pigment Adsorbing Portion | | STMA | Molecular Weight | | Average Number in One Molecule of Pigment Dispersant | | |
| | (Mole) | (Structure) | (Mole) | (Mole) | Mn | Mw | Styrene | Adsorbing Portion | STMA |
| S1 | 90 | A1 | 4 | 6 | 12000 | 21000 | 82.6 | 3.7 | 5.5 |
| S2 | 96 | A1 | 4 | 0 | 12500 | 22000 | 102.8 | 4.3 | 0 |
| S3 | 92 | A1 | 2 | 6 | 11500 | 24000 | 85.0 | 1.8 | 5.5 |
| S4 | 88 | A1 | 6 | 6 | 13000 | 25000 | 83.5 | 5.7 | 5.7 |
| S5 | 84 | A1 | 10 | 6 | 12500 | 24000 | 70.2 | 8.4 | 5.0 |
| S6 | 90 | A3 | 4 | 6 | 10500 | 19500 | 72.3 | 3.2 | 4.8 |
| S7 | 90 | A6 | 4 | 6 | 12000 | 21500 | 81.9 | 3.6 | 5.5 |
| S8 | 90 | A2 | 4 | 6 | 13600 | 23000 | 93.5 | 4.2 | 6.2 |
| S9 | 90 | A4 | 4 | 6 | 11000 | 21000 | 75.1 | 3.3 | 5.0 |
| S10 | 90 | A5 | 4 | 6 | 12000 | 22000 | 80.1 | 3.6 | 5.3 |
| S11 | 90 | A10 | 4 | 6 | 11000 | 22500 | 74.0 | 3.3 | 4.9 |
| S12 | 90 | A7 | 4 | 6 | 9500 | 19500 | 65.4 | 2.9 | 4.4 |
| S13 | 90 | A8 | 4 | 6 | 11500 | 21500 | 79.1 | 3.5 | 5.3 |
| S14 | 90 | A9 | 4 | 6 | 13000 | 23500 | 89.1 | 4.0 | 5.9 |
| S15 | 90 | A3 | 4 | 0 | 13000 | 24500 | 105.9 | 4.7 | 0 |
| S16 | 90 | A3 | 4 | 0 | 4500 | 8500 | 36.7 | 1.6 | 0 |
| S17 | 90 | A3 | 4 | 0 | 6500 | 11500 | 53.0 | 2.4 | 0 |
| S18 | 90 | A3 | 4 | 0 | 21500 | 48000 | 175.2 | 7.8 | 0 |
| S19 | 90 | A3 | 4 | 0 | 38000 | 79500 | 309.7 | 13.8 | 0 |
| S20 | 90 | A11 | 4 | 6 | 10500 | 22500 | 74.9 | 3.3 | 5.0 |

In Table 2, "STMA" indicates stearyl methacrylate.

<Synthesis of Polar Resin>

(Synthesis of Polar Resin, P1)

Into a reaction vessel equipped with a stirrer, a condenser, a thermometer, and a nitrogen introducing pipe, 200 parts of xylene was charged. After 100 parts of a mixture in which raw material monomers were mixed together at a molar ratio shown in Table 3 and 7.68 parts of dimethyl-2,2'-azobis(2-methylpropionate) functioning as a polymerization initiator were mixed to each other, the mixture thus prepared was dripped into the reaction vessel while stirring was performed. Heating and stirring were performed at 65° C., and when a desired molecular weight was obtained, the reaction liquid was cooled, so that the reaction was stopped. After the reaction liquid was purified by solid-liquid separation in methanol, drying was performed at 40° C. and a reduced pressure, so that a polar resin P1 was obtained. By the methods described above, the molecular weight and the acid value were analyzed. The physical properties of the polar resin P1 thus obtained are shown in Table 3.

(Synthesis of Polar Resins P2 and P3)

Except that the raw material monomer types and the charge amounts thereof were changed as shown in Table 3, polar resins P2 and P3 were synthesized by a method similar to that of the polar resin P1. The analytical results of the polar resins P2 and P3 thus obtained are shown in Table 3.

TABLE 3

| | Composition (Molar Ratio) | | | | | | Physical Properties | | |
|---|---|---|---|---|---|---|---|---|---|
| | | | | | | | Number | Weight | |
| Polar Resin | Styrene | 2-Acrylamide-2-Methylpropane Sulfonic Acid | Carboxy Group-Containing Monomer | Acrylic Acid | 2-Ethylhexyl Acrylate | Butyl Acrylate | Average Molecular Weight (Mn) | Average Molecular Weight (Mw) | Acid Value (mgKOH/g) |
| P1 | 87 | 3 | 0 | 0 | 10 | 0 | 11000 | 26000 | 14.6 |
| P2 | 90 | 0 | 4 | 0 | 0 | 6 | 11500 | 25000 | 19.5 |
| P3 | 94.5 | 2.5 | 0 | 3 | 0 | 0 | 11000 | 25500 | 29.2 |

In Table 3, the carboxy group-containing monomer is a monomer represented by the following formula (7).

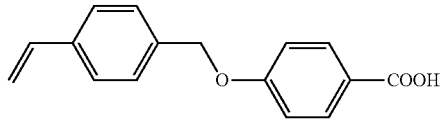

(7)

(Synthesis of Polar Resin P4)

In a reaction vessel equipped with a stirrer, a thermometer, a nitrogen introducing pipe, a dehydration pipe, and a pressure reduction unit, 100 parts of a mixture in which raw material monomers were mixed together at a molar ratio shown in Table 4 was added and then heated to a temperature of 130° C. with stirring. Subsequently, after 0.52 parts of di(2-ethylhexanoic acid)tin was added as an esterification catalyst, and the temperature was increased to 200° C., condensation polymerization was performed until a desired molecular weight was obtained, so that a polar resin P4 was obtained. By the methods described above, the molecular weight and the acid value were analyzed. The physical properties of the polar resin P4 thus obtained are shown in Table 4.

(Synthesis of Polar Resins P5 to P8)

Except that the raw material monomer types and the charge amounts thereof were changed as shown in Table 4 polar resins P5 to P8 were synthesized by a method similar to that of the polar resin P4. The analytical results of the polar resins P5 to P8 are shown in Table 4.

TABLE 4

| Polar Resin | Composition (Molar Ratio) Acid Monomer TPA | TMA | CHDA | Alcohol Monomer BPA-PO | EG | Isosorbide | Physical Properties Number Average Molecular Weight (Mn) | Weight Average Molecular Weight (Mw) | Acid Value (mgKOH/g) |
|---|---|---|---|---|---|---|---|---|---|
| P4 | 46.0 | 2.0 | 0.0 | 25.0 | 22.0 | 5.0 | 6000 | 23000 | 2.5 |
| P5 | 28.0 | 2.0 | 20.0 | 30.0 | 20.0 | 0.0 | 3200 | 14000 | 5.2 |
| P6 | 25.0 | 0.0 | 30.0 | 25.0 | 20.0 | 0.0 | 2100 | 8900 | 10.6 |
| P7 | 60.0 | 0.0 | 0.0 | 20.0 | 20.0 | 0.0 | 2000 | 8500 | 15.2 |
| P8 | 65.0 | 5.0 | 0.0 | 15.0 | 15.0 | 0.0 | 2800 | 12000 | 19.4 |

In Table 4, "TPA", "TMA", "CHDA", "BPA-PO", and "EG" represent terephthalic acid, trimellitic acid, cyclohexanedicarboxylic acid, propylene oxide (2 mol) adduct of bisphenol A, and ethylene glycol, respectively.

<Manufacturing Example of Black Toner Particles 1>

(Preparation Step of Colorant Dispersion Liquid 1)

| | |
|---|---|
| Styrene | 100.0 parts |
| Carbon black (CB) | 20.0 parts |
| Nipex35 (manufactured by Orion Engineered Carbons) | |
| Pigment dispersant (S1) | 2.0 parts |

The above materials were charged into an attritor (manufactured by Mitsui Mining Co., Ltd.) and then stirred at 25° C. and at 200 rpm for 180 minutes using 200 parts of zirconia beads having a radius of 2.5 mm, so that a colorant dispersion liquid 1 was prepared.

(Preparation Step of Toner Composition Solution)

| | |
|---|---|
| Colorant dispersion liquid 1 | 40.0 parts |
| Styrene | 33.5 parts |
| n-butyl acrylate | 24.5 parts |
| Polar resin (P1) | 2.0 parts |
| Release agent, paraffin wax (HNP-9: manufactured by Nippon Seiro Co., Ltd., melting point: 75° C.) | 10.0 parts |

After the above materials were mixed together and heated to 65° C., the mixture thus obtained was uniformly dissolved and dispersed at 5,000 rpm for 60 minutes using a T.K. homomixer (manufactured by Tokushu Kika Kogyo Co., Ltd), so that a toner composition solution 1 was obtained.

(Preparation Step of Dispersion Liquid of Black Toner Particles 1)

After 450 parts of 0.1 M-$Na_3PO_4$ aqueous solution was charged to 710 parts of ion exchanged water in a 2-liter four-port flask equipped with a T.K. homomixer, heating was performed to 60° C. Subsequently, 67.7 parts of 1.0 M-$CaCl_2$ aqueous solution was gradually added, so that an aqueous medium containing calcium phosphate was obtained. Next, after 8 parts of 70%-toluene solution of 1,1,3,3-tetramethylbutyl peroxy-2-ethylhexanoate functioning as a polymerization initiator was dissolved in the toner composition solution 1 and then sufficiently mixed together, the mixture thus prepared was charged to the above aqueous medium. The mixture obtained as described above was stirred at 62° C. and at 12,000 rpm for 10 minutes in a nitrogen atmosphere, so that particles of a polymerizable monomer composition were formed. Subsequently, while stirring was performed using a paddle stirring blade, the temperature was increased to 75° C., and polymerization was performed for 7.5 hours, so that the polymerization reaction was completed. Next, a remaining monomer was distilled off at a reduced pressure, and the aqueous medium was cooled, so that a dispersion liquid of black toner particles 1 was obtained.

After a hydrochloric acid was added to the dispersion liquid of the black toner particles 1 to have a pH of 1.4, stirring was performed for 1 hour, so that calcium phosphate was dissolved. This dispersion liquid was processed by solid-liquid separation using a pressure filtration device, so that a toner cake was obtained. After a washing operation using ion exchanged water was repeatedly performed three times, drying was performed, so that the black toner particles 1 were obtained. The physical properties of the black toner particles 1 are shown in Table 5. The weight average particle diameter (D4) of the black toner particles 1 thus obtained was 5.5 μm.

<Manufacturing Examples of Black Toner Particles 2 to 14 and 17 to 40>

In the manufacturing example of the black toner particles 1, except that the composition of the black toner particles 1 was changed as shown in Tables 5 and 6, black toner particles 2 to 14 and 17 to 40 were obtained by a method similar to that described above. The physical properties of the black toner particles 2 to 14 and 17 to 40 are shown in Tables 5 and 6.

<Manufacturing Example of Black Toner Particles 15>

(Preparation Step of Colorant Dispersion Liquid 2)

| | |
|---|---|
| Toluene | 350.0 parts |
| Carbon black (CB) | 56.0 parts |
| Nipex35 (manufactured by Orion Engineered Carbons) | |
| Pigment dispersant (S1) | 5.6 parts |

The above materials were charged into an attritor (manufactured by Mitsui Mining Co., Ltd.) and were stirred at 25°

C. and at 200 rpm for 180 minutes using 200 parts of zirconia beads having a radius of 2.5 mm, so that a colorant dispersion liquid 2 was prepared.

(Preparation Step of Toner Composition Solution 2)

| | |
|---|---|
| Colorant dispersion liquid 2 | 250.0 parts |
| Polar resin (P1) | 10.0 parts |
| Styrene acrylic resin (Copolymer of styrene:n-butyl acrylate = 75:25 (mass ratio)) (Mw: 30,000, Tg: 55° C.) | 490.0 parts |
| release agent, paraffin wax (HNP-9: manufactured by Nippon Seiro Co., Ltd., melting point: 75° C.) | 50.0 parts |

After the above materials were mixed together and heated to 65° C., the mixture thus obtained was uniformly dispersed at 5,000 rpm for 60 minutes using T.K. homomixer, so that a toner composition solution 2 was obtained.

(Preparation Step of Toner Particle Dispersion Liquid 2)

After 300 parts of 0.5 M-$Na_3PO_4$ aqueous solution was charged to 1,200 parts of ion exchanged water in a 2-liter four-port flask equipped with a T.K. homomixer, the mixture thus obtained was heated to 60° C. at a controlled revolution rate of 12,000 rpm. Subsequently, 25.7 parts of 1.0 M-$CaCl_2$ aqueous solution was gradually added, so that an aqueous medium containing calcium phosphate was obtained.

Next, the toner composition solution 2 was charged to the above aqueous medium. The mixture thus obtained was stirred at 65° C. and at 12,000 rpm for 30 minutes in a nitrogen atmosphere, so that particles of the toner composition solution 2 were formed. Subsequently, the solvent was distilled off at a reduced pressure, and the aqueous medium was cooled, so that a black toner particle dispersion liquid 15 was obtained.

After a hydrochloric acid was added to the black toner particle dispersion liquid to have a pH of 1.4, stirring was performed for 1 hour, so that calcium phosphate was dissolved. This dispersion liquid was processed by solid-liquid separation using a pressure filtration device, so that a toner cake was obtained. After a washing operation using ion exchanged water was repeatedly performed three times, drying was performed, so that black toner particles 15 were obtained. The physical properties of the black toner particles 15 are shown in Table 5. The weight average particle diameter (D4) of the black toner particles 15 thus obtained was 6.2 μm.

<Manufacturing Example of Black Toner Particles 16>

| | |
|---|---|
| Styrene Acrylic resin (Copolymer of styrene: n-butyl acrylate = 75:25 (mass ratio)) (Mw: 30,000, Tg: 55° C.) | 98.0 parts |
| Polar resin 1 (P1) | 2.0 parts |
| Carbon black (CB) (Nipex35 (manufactured by Orion engineered Carbons) | 8.0 parts |
| release agent, paraffin wax (HNP-9: manufactured by Nippon Seiro Co., Ltd., melting point: 75° C.) | 10.0 parts |
| Pigment dispersant (S1) | 0.8 parts |

The above materials were sufficiently mixed together using an FM mixer (manufactured by Nippon Coke & Engineering Co., Ltd.) and were then kneaded by a double-screw kneader controlled at a temperature of 130° C. The kneaded product thus obtained was cooled and then coarsely pulverized using a hammer mill into a size of 2 mm or less, so that a coarsely pulverized product was obtained.

The coarsely pulverized product thus obtained was finely pulverized using a mechanical pulverizer (Turbo Mill Model T250-RS, manufactured by Turbo Kogyo Co., Ltd.). Subsequently, the finely pulverized product thus obtained was sieved by a multistage sieving machine using a Coanda effect, so that black toner particles 16 were obtained. The physical properties of the black toner particles 16 are shown in Table 5.

TABLE 5

| | | Resin Component | | | | | | | | | |
|---|---|---|---|---|---|---|---|---|---|---|---|
| | Manufacturing | Polar Resin | | Others | | Pigment | | Pigment Dispersant | | Adsorbing Rate | Particle Diameter |
| Black Toner | Method | Type | Parts | Type | Parts | Type | Parts | Type | Parts | (%) | D4 (μm) |
| Black Toner Particles 1 | Suspension Polymerization | P1 | 2.0 | St/BA | 73.5/24.5 | CB | 8.0 | S1 | 0.8 | 94 | 5.5 |
| Black Toner Particles 2 | Suspension Polymerization | P1 | 2.0 | St/BA | 73.5/24.5 | CB | 8.0 | S2 | 0.8 | 98.3 | 5.8 |
| Black Toner Particles 3 | Suspension Polymerization | P1 | 2.0 | St/BA | 73.5/24.5 | CB | 8.0 | S3 | 0.8 | 91.2 | 5.9 |
| Black Toner Particles 4 | Suspension Polymerization | P1 | 2.0 | St/BA | 73.5/24.5 | CB | 8.0 | S4 | 0.8 | 93.5 | 6.1 |
| Black Toner Particles 5 | Suspension Polymerization | P1 | 2.0 | St/BA | 73.5/24.5 | CB | 8.0 | S5 | 0.8 | 94.2 | 5.7 |
| Black Toner Particles 6 | Suspension Polymerization | P1 | 2.0 | St/BA | 73.5/24.5 | CB | 8.0 | S6 | 0.8 | 94.3 | 5.7 |
| Black Toner Particles 7 | Suspension Polymerization | P1 | 2.0 | St/BA | 73.5/24.5 | CB | 8.0 | S7 | 0.8 | 93.2 | 5.8 |
| Black Toner Particles 8 | Suspension Polymerization | P1 | 2.0 | St/BA | 73.5/24.5 | CB | 8.0 | S8 | 0.8 | 87.1 | 6.2 |
| Black Toner Particles 9 | Suspension Polymerization | P1 | 2.0 | St/BA | 73.5/24.5 | CB | 8.0 | S9 | 0.8 | 88.8 | 5.9 |
| Black Toner Particles 10 | Suspension Polymerization | P1 | 2.0 | St/BA | 73.5/24.5 | CB | 8.0 | S10 | 0.8 | 89.2 | 6.1 |
| Black Toner Particles 11 | Suspension Polymerization | P1 | 2.0 | St/BA | 73.5/24.5 | CB | 8.0 | S11 | 0.8 | 93.3 | 6.0 |

TABLE 5-continued

| | | Resin Component | | | | | | | | | |
|---|---|---|---|---|---|---|---|---|---|---|---|
| | Manufacturing | Polar Resin | | Others | | Pigment | | Pigment Dispersant | | Adsorbing Rate | Particle Diameter |
| Black Toner | Method | Type | Parts | Type | Parts | Type | Parts | Type | Parts | (%) | D4 (μm) |
| Black Toner Particles 12 | Suspension Polymerization | P1 | 2.0 | St/BA | 73.5/24.5 | CB | 8.0 | S12 | 0.8 | 85.2 | 5.9 |
| Black Toner Particles 13 | Suspension Polymerization | P1 | 2.0 | St/BA | 73.5/24.5 | CB | 8.0 | S13 | 0.8 | 84.6 | 6.0 |
| Black Toner Particles 14 | Suspension Polymerization | P1 | 2.0 | St/BA | 73.5/24.5 | CB | 8.0 | S14 | 0.8 | 80.4 | 5.6 |
| Black Toner Particles 15 | Dissolution Suspension | P1 | 2.0 | Styrene Acrylic Resin 1 | 73.5/24.5 | CB | 8.0 | S6 | 0.8 | 94 | 6.2 |
| Black Toner Particles 16 | Pulverization | P1 | 2.0 | Styrene Acrylic Resin 1 | 73.5/24.5 | CB | 8.0 | S6 | 0.8 | 94.0 | 5.9 |
| Black Toner Particles 17 | Suspension Polymerization | P1 | 2.0 | St/BA | 73.5/24.5 | CB | 8.0 | S16 | 0.8 | 91.1 | 5.8 |
| Black Toner Particles 18 | Suspension Polymerization | P1 | 2.0 | St/BA | 73.5/24.5 | CB | 8.0 | S17 | 0.8 | 93.3 | 5.9 |
| Black Toner Particles 19 | Suspension Polymerization | P1 | 2.0 | St/BA | 73.5/24.5 | CB | 8.0 | S18 | 0.8 | 97.5 | 6.0 |
| Black Toner Particles 20 | Suspension Polymerization | P1 | 2.0 | St/BA | 73.5/24.5 | CB | 8.0 | S19 | 0.8 | 95.1 | 5.8 |

TABLE 6

| | | Resin Component | | | | | | | | | |
|---|---|---|---|---|---|---|---|---|---|---|---|
| | Manufacturing | Polar Resin | | Others | | Pigment | | Pigment Dispersant | | Adsorbing Rate | Particle Diameter |
| Black Toner | Method | Type | Parts | Type | Parts | Type | Parts | Type | Parts | (%) | D4 (μm) |
| Black Toner Particles 21 | Suspension Polymerization | P4 | 5.0 | St/BA | 71.3/23.8 | CB | 8.0 | S1 | 0.8 | 94.0 | 6.2 |
| Black Toner Particles 22 | Suspension Polymerization | P4 | 10.0 | St/BA | 67.5/22.5 | CB | 8.0 | S1 | 0.8 | 94.0 | 6.1 |
| Black Toner Particles 23 | Suspension Polymerization | P4 | 20.0 | St/BA | 60.0/20.0 | CB | 8.0 | S1 | 0.8 | 94.0 | 6.3 |
| Black Toner Particles 24 | Suspension Polymerization | P4 | 30.0 | St/BA | 52.5/17.5 | CB | 8.0 | S1 | 0.8 | 94.0 | 6.3 |
| Black Toner Particles 25 | Suspension Polymerization | P4 | 40.0 | St/BA | 45.0/15.0 | CB | 8.0 | S1 | 0.8 | 94.0 | 6.5 |
| Black Toner Particles 26 | Suspension Polymerization | P5 | 5.0 | St/BA | 71.3/23.8 | CB | 8.0 | S1 | 0.8 | 94.0 | 6.0 |
| Black Toner Particles 27 | Suspension Polymerization | P6 | 5.0 | St/BA | 71.3/23.8 | CB | 8.0 | S1 | 0.8 | 94.0 | 5.8 |
| Black Toner Particles 28 | Suspension Polymerization | P7 | 5.0 | St/BA | 71.3/23.8 | CB | 8.0 | S1 | 0.8 | 94.0 | 5.8 |
| Black Toner Particles 29 | Suspension Polymerization | P8 | 5.0 | St/BA | 71.3/23.8 | CB | 8.0 | S1 | 0.8 | 94.0 | 5.6 |
| Black Toner Particles 30 | Suspension Polymerization | P2 | 5.0 | St/BA | 71.3/23.8 | CB | 8.0 | S1 | 0.8 | 94.0 | 5.7 |
| Black Toner Particles 31 | Suspension Polymerization | P3 | 0.05 | St/BA | 75.0/25.0 | CB | 8.0 | S1 | 0.8 | 94.0 | 6.5 |
| Black Toner Particles 32 | Suspension Polymerization | P3 | 0.1 | St/BA | 74.9/25.0 | CB | 8.0 | S1 | 0.8 | 94.0 | 6.4 |
| Black Toner Particles 33 | Suspension Polymerization | P3 | 1.0 | St/BA | 74.3/24.8 | CB | 8.0 | S1 | 0.8 | 94.0 | 6.1 |
| Black Toner Particles 34 | Suspension Polymerization | P3 | 5.0 | St/BA | 71.3/23.8 | CB | 8.0 | S1 | 0.8 | 94.0 | 5.9 |
| Black Toner Particles 35 | Suspension Polymerization | P3 | 10.0 | St/BA | 67.5/22.5 | CB | 8.0 | S1 | 0.8 | 94.0 | 5.7 |
| Black Toner Particles 36 | Suspension Polymerization | P1/P4 | 2.0/10.0 | St/BA | 66.0/22.0 | CB | 8.0 | S1 | 0.8 | 94.0 | 5.8 |
| Black Toner Particles 37 | Suspension Polymerization | P1/P6 | 2.0/5.0 | St/BA | 69.8/23.3 | CB | 8.0 | S1 | 0.8 | 94.0 | 5.7 |
| Black Toner Particles 38 | Suspension Polymerization | P1/P4 | 2.0/30.0 | St/BA | 51.0/17.0 | CB | 8.0 | S1 | 0.8 | 94.0 | 6.2 |
| Black Toner Particles 39 | Suspension Polymerization | P1 | 2.0 | St/BA | 73.5/24.5 | CB | 8.0 | — | — | — | 5.8 |
| Black Toner Particles 40 | Suspension Polymerization | P1 | 2.0 | St/BA | 73.5/24.5 | CB | 8.0 | S20 | 0.8 | 84.3 | 5.9 |

<Manufacturing Example of Magenta Toner Particles 1>
(Preparation Step of Colorant Dispersion Liquid 3)

| | |
|---|---|
| Styrene | 100.0 parts |
| C.I. Pigment Red 122 (PR-122) | 16.7 parts |
| (Toner Magenta E [manufactured by Clariant] | |
| Pigment dispersant (S1) | 1.67 parts |

The above materials were charged into an attritor (manufactured by Mitsui Mining Co., Ltd.) and were stirred at 25° C. and at 200 rpm for 180 minutes using 200 parts of zirconia beads having a radius of 2.5 mm, so that a colorant dispersion liquid 3 was prepared.

(Preparation Step of Toner Composition Solution 3)

| | |
|---|---|
| Colorant dispersion liquid 3 | 53.9 parts |
| Styrene | 19.6 parts |
| n-butyl acrylate | 24.5 parts |
| release agent, paraffin wax | 10.0 parts |
| (HNP-9: manufactured by Nippon Seiro Co., Ltd., melting point: 75° C.) | |
| Polar resin (P1) | 2.0 parts |

After the above materials were mixed together and heated to 65° C., the mixture thus obtained was uniformly dissolved and dispersed at 5,000 rpm for 60 minutes using a T.K. homomixer, so that a toner composition solution 3 was obtained.

Hereinafter, by the use of the toner composition solution 3, magenta toner particles 1 were obtained as was the case of the black toner particles 1. The weight average particle diameter (D4) of the magenta toner particles 1 thus obtained was 6.1 μm. The physical properties of the magenta toner particles 1 thus obtained are shown in Table 6.

<Manufacturing Examples of Magenta Toner Particles 2 to 7>

In the manufacturing example of the magenta toner particles 1, except that the composition of the magenta toner particles 1 was changed as shown in Table 7, magenta toner particles 2 to 7 were obtained by a method similar to that described above. The physical properties of the magenta toner particles 2 to 7 thus obtained are shown in Table 7.

<Manufacturing Example of Yellow Toner Particles 1>
(Preparation Step of Colorant Dispersion Liquid 4)

| | |
|---|---|
| Styrene | 100.0 parts |
| C.I. Pigment Yellow 155 (PY-155) | 16.7 parts |
| (Peliotol Yellow D1155 [manufactured by BASF] | |
| Pigment dispersant (S1) | 1.67 parts |

The above materials were charged into an attritor (manufactured by Mitsui Mining Co., Ltd.) and were stirred at 25° C. and at 200 on for 180 minutes using 200 parts of zirconia beads having a radius of 2.5 mm, so that a colorant dispersion liquid 4 was prepared.

(Preparation Step of Toner Composition Solution 4)

| | |
|---|---|
| Colorant dispersion liquid 4 | 53.9 parts |
| Styrene | 19.6 parts |
| n-butyl acrylate | 24.5 parts |
| release agent, paraffin wax | 10.0 parts |
| (HNP-9: manufactured by Nippon Seiro Co., Ltd., melting point: 75° C.) | |
| Polar resin (P1) | 2.0 parts |

After the above materials were mixed together and heated to 65° C., the mixture thus obtained was uniformly dispersed at 5,000 rpm for 60 minutes using a T.K. homomixer, so that a toner composition solution 4 was obtained.

Hereinafter, by the use of the toner composition solution 4, yellow toner particles 1 were obtained as was the case of the black toner particles 1. The weight average particle diameter (D4) of the yellow toner particles thus obtained was 6.2 μm. In addition, the adsorbing rate of the pigment dispersant used in this example to the yellow pigment was 63.9%.

<Manufacturing Example of Toner>

By using a Mitsui Henschel mixer (manufactured by Mitsui Miike Chemical Engineering Machinery, Co., Ltd.), 100.0 parts of the black toner particles 1 and 1.5 parts of a hydrophobic silica fine powder were mixed together for 300

TABLE 7

| Magenta Toner | Manufacturing Method | Resin Component: Polar Resin Type | Polar Resin Parts | Others Type | Others Parts | Pigment Type | Pigment Parts | Pigment Dispersant Type | Pigment Dispersant Parts | Adsorbing Rate (%) | Particle Diameter D4 (μm) |
|---|---|---|---|---|---|---|---|---|---|---|---|
| Magenta Toner Particles 1 | Suspension Polymerization | P1 | 2.0 | St/BA | 73.5/24.5 | PR122 | 9.0 | S1 | 0.9 | 99.2 | 6.1 |
| Magenta Toner Particles 2 | Suspension Polymerization | P1 | 2.0 | St/BA | 73.5/24.5 | PR150 | 9.0 | S1 | 0.9 | 75.2 | 6.3 |
| Magenta Toner Particles 3 | Suspension Polymerization | P1 | 2.0 | St/BA | 73.5/24.5 | PR122 | 9.0 | S15 | 0.05 | 99.1 | 6.2 |
| Magenta Toner Particles 4 | Suspension Polymerization | P1 | 2.0 | St/BA | 73.5/24.5 | PR122 | 9.0 | S15 | 0.09 | 99.1 | 6.0 |
| Magenta Toner Particles 5 | Suspension Polymerization | P1 | 2.0 | St/BA | 73.5/24.5 | PR122 | 9.0 | S15 | 0.45 | 99.1 | 5.9 |
| Magenta Toner Particles 6 | Suspension Polymerization | P1 | 2.0 | St/BA | 73.5/24.5 | PR122 | 9.0 | S15 | 3.6 | 99.1 | 6.0 |
| Magenta Toner Particles 7 | Suspension Polymerization | P1 | 2.0 | St/BA | 73.5/24.5 | PR122 | 9.0 | S15 | 5.4 | 99.1 | 6.1 |

seconds, so that a black toner 1 was obtained. Incidentally, the silica fine powder used in this case was a hydrophobic silica fine powder surface-treated by hexamethyldisilazane, and the number average particle diameter (D1) of the primary particles thereof was 10 nm.

By a method similar to that described above, the above hydrophobic silica fine powder was mixed with each of the black toner particles 2 to 40, the magenta toner particles 1 to 7, and the yellow toner particles 1, so that black toners 2 to 40, magenta toners 1 to 7, and a yellow toner 1 were obtained.

Examples 1 to 45 and Comparative Examples 1 and 2

The following evaluations were performed on the black toner 1.

<Evaluation of Coloring Power>

After a toner contained in a cartridge for a commercially available color laser printer Satera LBP7700C (manufactured by CANON KABUSHIKI KAISHA) was removed, the inside of the cartridge was cleaned by air blow, and the black toner 1 (150 g) was filled therein. In addition, the Satera LBP7700C was partially modified so that even if a fixing device was removed, an unfixed image could be output and was also modified so that the operation could be performed even when a one-color process cartridge was only mounted. After the above cartridge was mounted in the printer, the toner bearing amount was set to 0.30 mg/cm$^2$, and a rectangular solid image having a size of 6.5 cm×14.0 cm was output on the center of a transfer material as an evaluation image. As the transfer material, letter-size HP LASERJET PAPER (manufactured by Hewlett Packard, 90.0 g/m$^2$) was used.

By the use of an external fixing device of the LBP77000, the evaluation image thus output was fixed at 160° C. and at a process speed of 300 mm/sec, and the image density was measured, so that the coloring power was evaluated. In this case, the measurement of the image density was performed using "X-Rite color reflection densitometer (color reflection densitometer X-Rite404A)". In order to obtain the density of the print-out image relative to that of a white underlying portion having an image density of 0.00, measurement of the density was performed at five positions located at the upper right, the upper left, the center, the lower right, and the lower left portions, and the average value obtained therefrom was regarded as the image density. The evaluation criteria were as described below. The level C or more was regarded as a level at which the effect of aspects of the present invention was obtained. The results are shown in Table 8.

A: The image density is 1.50 or more.
B: The image density is 1.35 or more and less than 1.50.
C: The image density is 1.20 or more and less than 1.35.
D: The image density is less than 1.20.

<Evaluation of Charging Property>

The black toner 1 and Ferrite Carrier F813-300 (manufactured by Powdertech Co., Ltd.) were mixed together to have a toner concentration of 6.0 percent by mass, so that a two-component developer was formed.

(Evaluation of Buildup Property of Toner Charge Amount)

After 50 g of the above two-component developer was placed in a 50-cc plastic cup, the plastic cup was left in a normal temperature and normal humidity environment (23° C./60% RH) for 4 days. Subsequently, shaking was performed 30 times for 15 seconds, and shaking was then performed 180 times for 90 seconds.

By the use of a device (suction device 1) shown in FIG. 1, 0.1 g of the two-component developer which was shook as described above was placed in a metal-made measurement container 2 having a 635-mesh screen 3 at a bottom side thereof, and a metal-made lid 4 was placed on the container. The mass of the total container was weighed and represented by W1 (g). Next, In the suction device (portion in contact with the measurement container 2 was formed of an insulating material), suction was performed from a suction port 7, and the pressure measured by a vacuum meter 5 was set to 1.0 kPa by adjusting a now volume adjusting valve 6. Under the conditions described above, suction was performed for 1 minute, so that the toner was removed thereby. In this case, the potential measured by an electrometer 9 and the capacity of a capacitor 8 were represented by V (volt) and C (mCF), respectively, and after the suction was performed, the mass of the measurement container was weighed and represented by W2 (g). The charge amount (mC/kg) of this toner was calculated in accordance with the following formula.

$$\text{Charge amount (mC/kg)}=(C\times V)/(W1-W2)$$

The evaluation was performed by measurement of the absolute value of the friction charge amount at each of the number of shakings, and the level C or more was regarded as a level at which the effect of aspects of the present invention was obtained. The results are shown in Table 8.

The evaluation was performed by the rate of the absolute value of the friction charge amount measured after the shaking was performed 30 times to the absolute value of the friction charge amount measured after the shaking was performed 180 times.

A: 90% or more
B: 80% or more and less than 90%
C: 70% or more and less than 80%
D: less than 70%

(Environmental Stability of Toner Charge)

After 50 g of the above two-component developer was placed in a 50-cc plastic cup, the plastic cup was left in a normal temperature and normal humidity environment (23° C./60% RH) for 4 days. Subsequently, after shaking was performed 30 times for 15 seconds, and shaking was then performed 180 times for 90 seconds, the charge amount was measured by the same method as described above. By a method similar to that described above, the charge amount was also measured in a high-temperature and high-humidity environment (30° C./80% RH). The charge amount in a normal temperature and normal pressure environment and the charge amount in a high-temperature and high-humidity environment were represented by N (mC/kg) and H (mC/kg), respectively, and the charge retention rate (%) in a high-temperature and high-pressure environment was calculated by the following formula. The level C or more was evaluated as a level at which the effect of aspects of the present invention was obtained. The results are shown in Table 8.

$$\text{Charge Retention Rate (\%)}=(\text{Charge Amount } H/\text{Charge Amount } N)\times 100$$

A: The charge retention rate is 80% or more.
B: The charge retention rate is 65 or more and less than 80%.
C: The charge retention rate is 50% or more and less than 65%.
D: The charge retention rate is less than 50%.

<Evaluation of Durability>

After a commercially available color laser printer (HP Color LaserJet 3525dn, manufactured by Hewlett Packard)

was modified so that the operation could be performed even when a one-color process cartridge was only mounted, evaluation was performed. After a toner filled in a cyan cartridge mounted in this color laser printer was removed, and the inside thereof was cleaned by air blow, the black toner 1 (200 g) was filled therein. In a normal temperature and normal humidity environment (23° C., 60% RH), by the use of Office Planner (64 g/m$^2$) manufactured by Canon KABUSHIKI KAISHA as image receiving paper, 50,000 sheets having a printing rate of 1% were continuously printed out. After the printing was completed, a halftone image was further output, and the presence or the absence of a vertical streak on a developing roller and the halftone image in a paper output direction was confirmed by observation. The durability was evaluated by the following criteria, and the level B or more was regarded as a level at which the effect of aspects of the present invention was obtained. The results are shown in Table 8.

A: Although no streak or only one thin streak is observed on the developing roller, no vertical streaks in a paper output direction are observed on the image of the halftone portion.

B: Although two to three thin streaks are observed on the developing roller, no vertical streaks in a paper output direction are observed on the image of the halftone portion.

C: Although four to five thin streaks are observed on the developing roller, no vertical streaks in a paper output direction are observed on the image of the halftone portion.

D: At least six thin streaks are observed on the developing roller, and at least one vertical streak in a paper output direction is observed on the image of the halftone portion.

Evaluation was also performed on the black toners 2 to 40, the magenta toners 1 to 7, and the yellow toner 1 by a method similar to that described above. The evaluation results are shown in Table 8.

TABLE 8

| | | Evaluation | | | | | | | |
|---|---|---|---|---|---|---|---|---|---|
| | | | | Charging Property | | | | | |
| | | Coloring Power | | Charge | | Charge | | Durability | |
| Example | Toner | Image Density | Rank | Buildup Rate (%) | Rank | Retention Rate (%) | Rank | Number of Streaks | Rank |
| Example 1 | Black Toner 1 | 1.58 | A | 96 | A | 84 | A | 0 | A |
| Example 2 | Black Toner 2 | 1.56 | A | 95 | A | 83 | A | 0 | A |
| Example 3 | Black Toner 3 | 1.50 | A | 89 | B | 85 | A | 1 | A |
| Example 4 | Black Toner 4 | 1.56 | A | 92 | A | 81 | A | 0 | A |
| Example 5 | Black Toner 5 | 1.51 | A | 90 | A | 82 | A | 1 | A |
| Example 6 | Black Toner 6 | 1.57 | A | 91 | A | 80 | A | 0 | A |
| Example 7 | Black Toner 7 | 1.56 | A | 93 | A | 85 | A | 0 | A |
| Example 8 | Black Toner 8 | 1.50 | A | 90 | A | 83 | A | 0 | A |
| Example 9 | Black Toner 9 | 1.52 | A | 88 | B | 81 | A | 1 | A |
| Example 10 | Black Toner 10 | 1.50 | A | 88 | B | 84 | A | 0 | A |
| Example 11 | Black Toner 11 | 1.50 | A | 87 | B | 81 | A | 0 | A |
| Example 12 | Black Toner 12 | 1.48 | B | 89 | B | 80 | A | 1 | A |
| Example 13 | Black Toner 13 | 1.47 | B | 88 | B | 81 | A | 0 | A |
| Example 14 | Black Toner 14 | 1.36 | B | 84 | B | 75 | B | 2 | B |
| Example 15 | Black Toner 15 | 1.55 | A | 91 | A | 83 | A | 1 | A |
| Example 16 | Black Toner 16 | 1.56 | A | 73 | C | 62 | C | 3 | B |
| Example 17 | Magenta Toner 1 | 1.55 | A | 93 | A | 83 | A | 0 | A |
| Example 18 | Magenta Toner 2 | 1.44 | B | 83 | B | 80 | A | 1 | A |
| Example 19 | Yellow Toner 1 | 1.38 | B | 82 | B | 80 | A | 1 | A |
| Example 20 | Magenta Toner 3 | 1.33 | C | 75 | C | 70 | B | 3 | B |
| Example 21 | Magenta Toner 4 | 1.41 | B | 84 | B | 75 | B | 2 | B |
| Example 22 | Magenta Toner 5 | 1.50 | A | 90 | A | 80 | A | 0 | A |
| Example 23 | Magenta Toner 6 | 1.56 | A | 91 | A | 83 | A | 0 | A |
| Example 24 | Magenta Toner 7 | 1.55 | A | 87 | B | 80 | A | 1 | A |
| Example 25 | Black Toner 17 | 1.46 | B | 90 | A | 81 | A | 0 | A |
| Example 26 | Black Toner 18 | 1.52 | A | 91 | A | 81 | A | 1 | A |
| Example 27 | Black Toner 19 | 1.55 | A | 93 | A | 82 | A | 0 | A |
| Example 28 | Black Toner 20 | 1.47 | B | 86 | B | 81 | A | 0 | A |
| Example 29 | Black Toner 21 | 1.54 | A | 90 | A | 72 | B | 0 | A |
| Example 30 | Black Toner 22 | 1.54 | A | 90 | A | 75 | B | 0 | A |
| Example 31 | Black Toner 23 | 1.51 | A | 91 | A | 76 | B | 1 | A |
| Example 32 | Black Toner 24 | 1.51 | A | 86 | B | 68 | B | 2 | B |
| Example 33 | Black Toner 25 | 1.50 | A | 83 | B | 61 | C | 3 | B |
| Example 34 | Black Toner 26 | 1.53 | A | 90 | A | 80 | A | 0 | A |
| Example 35 | Black Toner 27 | 1.55 | A | 91 | A | 81 | A | 1 | A |
| Example 36 | Black Toner 28 | 1.56 | A | 96 | A | 83 | A | 1 | A |
| Example 37 | Black Toner 29 | 1.54 | A | 90 | A | 83 | A | 1 | A |
| Example 38 | Black Toner 30 | 1.56 | A | 90 | A | 82 | A | 0 | A |
| Example 39 | Black Toner 31 | 1.52 | A | 74 | C | 56 | C | 3 | B |
| Example 40 | Black Toner 32 | 1.52 | A | 81 | B | 66 | B | 3 | B |
| Example 41 | Black Toner 33 | 1.51 | A | 90 | A | 80 | A | 0 | A |
| Example 42 | Black Toner 34 | 1.50 | A | 91 | A | 75 | B | 1 | A |
| Example 43 | Black Toner 35 | 1.46 | B | 88 | B | 66 | B | 3 | B |
| Example 44 | Black Toner 36 | 1.56 | A | 94 | A | 80 | A | 0 | A |
| Example 45 | Black Toner 37 | 1.55 | A | 91 | A | 81 | A | 0 | A |

TABLE 8-continued

| | | Evaluation | | | | | | | |
|---|---|---|---|---|---|---|---|---|---|
| | | | | Charging Property | | | | | |
| | | Coloring Power | | Charge | | Charge | | Durability | |
| Example | Toner | Image Density | Rank | Buildup Rate (%) | Rank | Retention Rate (%) | Rank | Number of Streaks | Rank |
| Example 46 | Black Toner 38 | 1.50 | A | 82 | B | 66 | B | 3 | B |
| Comparative Example 1 | Black Toner 39 | 1.19 | D | 62 | D | 49 | D | 6 | D |
| Comparative Example 2 | Black Toner 40 | 1.34 | C | 69 | D | 55 | C | 5 | C |

As apparent from Table 8, it is found that compared to the toners of the comparative examples, toner particles using both the pigment dispersant and the polar resin of aspects of the present invention are excellent in coloring power, charging property, and durability.

While aspects of the present invention have been described with reference to exemplary embodiments, it is to be understood that aspects of the invention are not limited to the disclosed exemplary embodiments. The scope of the following claims is to be accorded the broadest interpretation so as to encompass all such modifications and equivalent structures and functions.

This application claims the benefit of Japanese Patent Application No. 2015-171912 filed Sep. 1, 2015, which is hereby incorporated by reference herein in its entirety.

What is claimed is:

1. A toner comprising a toner particle, the toner particle containing:

a resin;

a pigment; and a pigment dispersant, wherein:

the resin comprises a polar resin having an acid value of 2.0 to 30.0 mgKOH/g, and the pigment dispersant comprises:

the structure represented by the following formula (1) or a tautomer thereof, and a polymer moiety having a vinyl copolymer structure or polyester structure, (1)

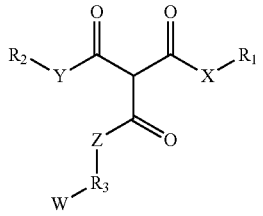

wherein:

X, Y and Z each independently represent —O—, a methylene group, or —$NR^4$—, and $R^4$ represents a hydrogen atom, or a linear or branched alkyl group having 1 to 4 carbon atoms, $R_1$ represents a substituted or unsubstituted phenyl group, a polycyclic aromatic group, or a heterocyclic group, $R_2$ represents a hydrogen atom, a substituted or unsubstituted phenyl group, an aralkyl group, a linear, branched, or cyclic alkyl group having 1 to 18 carbon atoms, or a monovalent group obtained by substituting a methylene group of a main chain of an alkyl group having 1 to 18 carbon atoms by an ether bond, an ester bond, or an amide bond, $R_3$ represents a substituted or unsubstituted phenylene group, a linear, branched, or cyclic alkylene group having 1 to 18 carbon atoms, or a divalent group obtained by substituting a methylene group of a main chain of an alkylene group having 1 to 18 carbon atoms by an ether bond, an ester bond, or an amide bond, W represents a linking group to the polymer moiety, a substituent of the substituted phenyl group and a substituent of the substituted phenylene group are each a methyl group, a methoxy group, a hydroxy group, a nitro group, a chloro group, a carboxy group, an amino group, a dimethylamino group, a carboxylic acid amide group, or a ureido group, the polycyclic aromatic group is a group obtained by naphthalene, anthracene, phenanthrene, or anthraquinone by removing one hydrogen atom therefrom, and the heterocyclic group is a group obtained by imidazole, oxazole, thiazole, pyridine, indole, benzimidazole, benzimidazolinone, or phthalimide by removing one hydrogen atom therefrom.

2. The toner according to claim 1, wherein the structure represented by the formula (1) is the structure represented by the following formula (2) or a tautomer thereof, (2)

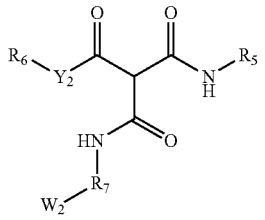

wherein:

$Y_2$ represents —O—, a methylene group, or —NH—, $R_6$ represents a hydrogen atom, a substituted or unsubstituted phenyl group, an aralkyl group, or a linear or branched alkyl group having 1 to 18 carbon atoms, $R_5$ represents a substituted or unsubstituted phenyl group, a polycyclic aromatic group, or a heterocyclic group, $R_7$ represents a linear or branched alkylene group having 1 to 8 carbon atoms, a divalent group obtained by substituting a methylene group of a main chain of an alkylene group having 1 to 8 carbon atoms by an ether bond, an ester bond, or an amide bond, or a substituted or unsubstituted phenylene group, $W_2$ represents a linking group to the polymer moiety, and the linking group is an ester bond or an amide bond, a substituent of the substituted phenyl group and a substituent of the substituted phenylene group are each a methyl group, a methoxy group, a hydroxy group, a nitro group, a chloro group, a carboxy group, an amino group, a dimethylamino group, a carboxylic acid amide group, or a ureido group, the polycyclic aromatic group is a group derived from naphthalene, anthracene, phenanthrene, or anthraquinone by removing one hydrogen atom therefrom, and the heterocyclic group is a group derived from imidazole, oxazole, thiazole, pyridine, indole, benzimidazole, benzimidazolinone, or phthalimide by removing one hydrogen atom therefrom.

3. The toner according to claim 2, wherein the structure represented by the formula (2) is the structure represented by the following formula (3) or a tautomer thereof, (3)

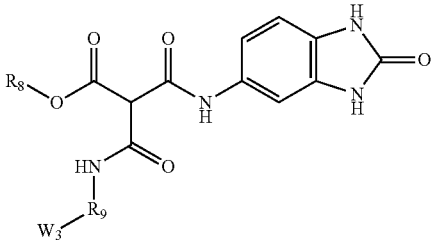

wherein:

$R_8$ represents an alkyl group having 1 to 12 carbon atoms or a benzyl group, $R_9$ represents an alkylene group having 2 to 4 carbon atoms, and $W_3$ represents a linking group to the polymer moiety, and the linking group is an ester bond or an amide bond.

4. The toner according to claim 1, wherein the pigment dispersant has an adsorbing rate to the pigment of 80.0% or more, as measured for a mixture obtained by mixing together 20.0 parts by mass of a solvent containing 16.0 parts by mass of styrene and 4.0 parts by mass of n-butyl acrylate, 0.1 parts by mass of the pigment dispersant, and 1.0 part by mass of the pigment.

5. The toner according to claim 1, wherein the content of the pigment dispersant is 1.0 to 50.0% by mass with respect to the pigment.

6. The toner according to claim 1, wherein the weight average molecular weight of the pigment dispersant is 10,000 to 50,000.

7. The toner according to claim 1, wherein the acid value of the polar resin is 5.0 to 20.0 mgKOH/g.

8. The toner according to claim 1, wherein the content of the polar resin is 0.1 to 30.0% by mass with respect to the total mass of the resin.

9. The toner according to claim 1, wherein the polar resin is a polyester resin or a vinyl resin.

10. A method for manufacturing a toner comprising a toner particle, the toner particle containing a resin, a pigment, and a pigment dispersant, the method comprising forming a particle in an aqueous medium to obtain the toner particle, wherein:

the resin comprises a polar resin having an acid value of 2.0 to 30.0 mgKOH/g, and the pigment dispersant comprises:

the structure represented by the following formula (1) or a tautomer thereof, and a polymer moiety having a vinyl copolymer structure or polyester structure, (1)

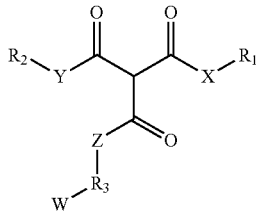

wherein:

X, Y and Z each independently represent —O—, a methylene group, or —$NR^4$—, and $R^4$ represents a hydrogen atom, or a linear or branched alkyl group having 1 to 4 carbon atoms, $R_1$ represents a substituted or unsubstituted phenyl group, a polycyclic aromatic group, or a heterocyclic group, $R_2$ represents a hydrogen atom, a substituted or unsubstituted phenyl group, an aralkyl group, a linear, branched, or cyclic alkyl group having 1 to 18 carbon atoms, or a monovalent group obtained by substituting a methylene group of a main chain of an alkyl group having 1 to 18 carbon atoms by an ether bond, an ester bond, or an amide bond, $R_3$ represents a substituted or unsubstituted phenylene group, a linear, branched, or cyclic alkylene group having 1 to 18 carbon atoms, or a divalent group obtained by substituting a methylene group of a main chain of an alkylene group having 1 to 18 carbon atoms by an ether bond, an ester bond, or an amide bond, W represents a linking group to the polymer moiety, a substituent of the substituted phenyl group and a substituent of the substituted phenylene group are each a methyl group, a methoxy group, a hydroxy group, a nitro group, a chloro group, a carboxy group, an amino group, a dimethylamino group, a carboxylic acid amide group, or a ureido group, the polycyclic aromatic group is a group obtained by naphthalene, anthracene, phenanthrene, or anthraquinone by removing one hydrogen atom therefrom, and the heterocyclic group is a group obtained by imidazole, oxazole, thiazole, pyridine, indole, benzimidazole, benzimidazolinone, or phthalimide by removing one hydrogen atom therefrom.

* * * * *